US005205328A

United States Patent [19]

Johnson et al.

[11] Patent Number: 5,205,328

[45] Date of Patent: Apr. 27, 1993

[54] PORTABLE CABLE TIE TOOL

[75] Inventors: Brett W. Johnson, Darien; Robert F. Levin, Braceville; Steven S. Timian, New Lenox; Mark B. Richardson, Joliet; David W. West, Naperville, all of Ill.

[73] Assignee: Panduit Corp., Tinley Park, Ill.

[21] Appl. No.: 853,464

[22] Filed: Mar. 18, 1992

[51] Int. Cl.[5] ..... B21F 9/02

[52] U.S. Cl. ..... 140/93.2; 140/93 A

[58] Field of Search ..... 140/93 A, 93.2, 123.6

[56] References Cited

U.S. PATENT DOCUMENTS

| | | | |
|---|---|---|---|
| 3,891,012 | 6/1975 | Bakermans . | |
| 3,976,108 | 8/1976 | Caveney et al. . | |
| 4,004,618 | 1/1977 | Turek . | |
| 4,357,970 | 11/1982 | Netta et al. . | |
| 4,359,070 | 11/1982 | Hidassy et al. . | |
| 4,371,010 | 2/1983 | Hidassy et al. . | |
| 4,495,972 | 1/1985 | Walker . | |
| 4,498,506 | 2/1985 | Moody et al. . | |
| 4,640,319 | 2/1987 | Walker . | |
| 4,640,320 | 2/1987 | Avison et al. . | |
| 5,042,535 | 8/1991 | Schlottke . | |
| 5,167,265 | 12/1992 | Sakamoto | 140/93.2 |

*Primary Examiner*—Lowell A. Larson

*Attorney, Agent, or Firm*—Charles R. Wentzel; Mark D. Hilliard

[57] ABSTRACT

A portable cable application tool for fastening an individual cable tie around an object where the cable tie has a strap and a strap locking head and is provided in a continuous ribbon of cable ties includes upper and lower jaws for positioning the cable tie around an object to be fastened. The tool includes a cable advancing means for advancing an individual cable tie within the tool having a carriage, a carriage mounting means for mounting the carriage to the tool for reciprocal movement between a rearward position and a forward position and cable tie pusher means carried on the carriage for pushing a cable tie from a cable tie receiver means to upper and lower jaws of the tool. The carriage includes insertion cam means disposed for engaging a linkage means to pivot the upper jaw and insert the cable tie when the carriage is advanced to the forward position whereby the movement of the carriage effects the timed advancement of the cable tie within the tool and the timed insertion of the cable tie through the locking head of the cable tie.

16 Claims, 27 Drawing Sheets

PORTABLE CABLE TIE TOOL

TECHNICAL FIELD

The present invention relates generally to automatic cable tie tools that secure a cable tie around a plurality of wires or objects to form a bundle, and specifically relates to tools that accept a ribbon of interconnected cable ties and sequentially remove the lead cable tie from the ribbon and advance it within the tool for application.

BACKGROUND OF THE INVENTION

Many different prior tools have been proposed that accept various types of cable tie ribbons for application of individual ties. One tool, disclosed in commonly assigned U.S. Pat. No. 4,498,506, utilizes a dispenser remote from a hand tool to separate individual ties from a ribbon and a pneumatic conveyance tube to convey each individual tie to an application tool which positions each tie around a bundle, tensions the tie to a pre-set tension and severs the end of the strap of the applied cable tie.

Propelling a cable tie through the conveyance tube at high velocity can result in damage to the locking mechanism of the cable tie. Although U.S. Pat. No. 4,498,506 discloses an effective cable tie braking mechanism for smaller size ties, larger ties of greater mass require a more effective braking system to minimize impact induced failure of the locking mechanism of the larger cable ties. In addition, other aspects of the cable tie positioning, tensioning and severing mechanism of this prior tool could be improved to provide a more reliable and desirable tool.

Other cable tie tools have been proposed that provide a mechanism for separating each cable tie from various types of cable tie ribbons contained within the hand tool. Thus, sections of cable tie ribbons of a discrete manageable length are positioned in the hand tool which sequentially separates, advances and applies each cable tie. Reference may be made to U.S. Pat. Nos. 4,359,070; 4,640,319; and 4,640,320.

Although the placement of the cable tie separating mechanism within the hand tool provides a tool that has the potential of being portable, the separating mechanism inherently increases the manufacturing complexity, the size and the weight of the tool. Thus, there is room for improvement in the art for a portable tool of minimal weight, minimal complexity and maximal reliability.

SUMMARY OF THE INVENTION

It is an object of the present invention to provide a portable automatic cable tie tool of reduced weight and complexity and of increased reliability.

It is another object of the present invention to provide an automatic cable tie tool having an improved mechanism for positioning the cable tie in the tool, tensioning the cable tie around an object, severing the excess strap of a cable tie and ejecting the cable tie from the tool.

In general, a portable cable tie tool of the present invention for fastening an individual cable tie around an object where the cable tie has a strap and a strap locking head and is provided in a continuous ribbon of cable ties includes upper and lower jaws for positioning the cable tie around an object to be fastened; tensioning means for withdrawing the strap of the cable tie from the locking head of the cable tie to tighten the cable tie around the object to be fastened; cable tie receiver means for positioning the ribbon of cable ties, separating a leading cable tie from the ribbon of cable ties and positioning the separated cable tie for advancement to the upper and lower jaws; and cable tie advancing means for advancing the separated cable tie into position in the upper and lower jaws including a carriage, carriage mounting means for mounting the carriage to the tool for reciprocal movement between a rearward position and a forward position and cable tie pusher means carried on the carriage for pushing the separated cable tie from the cable tie receiver means to the upper and lower jaws.

The upper jaw is pivotally mounted to the tool and operatively connected to a linkage means for pivoting the upper jaw upwardly within the lower jaw to insert the strap of a cable tie positioned therein through the locking head of the cable tie into engagement with the tensioning means and the carriage includes insertion cam means disposed for engaging the linkage means to actuate the linkage means to pivot the upper jaw and insert the cable tie when the carriage is advanced to the forward position whereby the movement of the carriage effects the timed advancement of the cable tie within the tool and the timed insertion of the cable tie through the locking head of the cable tie.

DESCRIPTION OF THE PREFERRED EMBODIMENTS

A portable cable tie installation tool embodying the concept of the present invention is generally indicated by the numeral 50 in the accompanying drawings.

Figure 7:
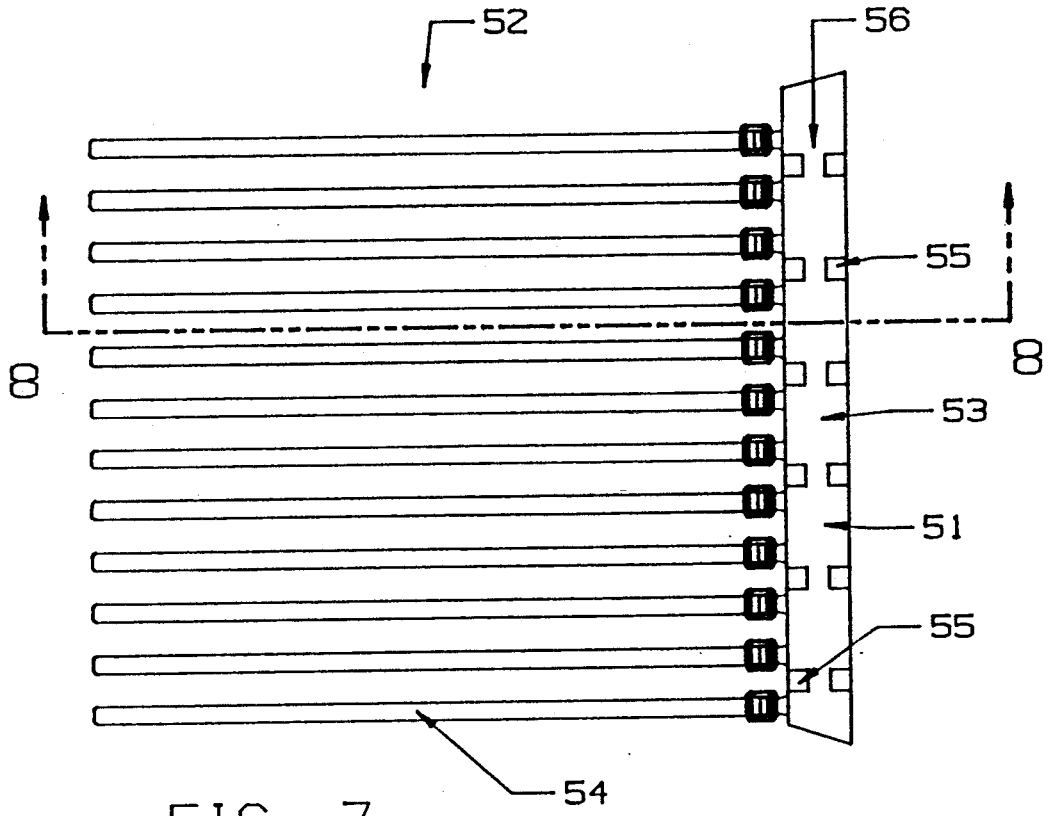
FIG. 7 is a top view of a ribbon of cable ties which is applied by the tool of FIG. 1.
Figure 8:
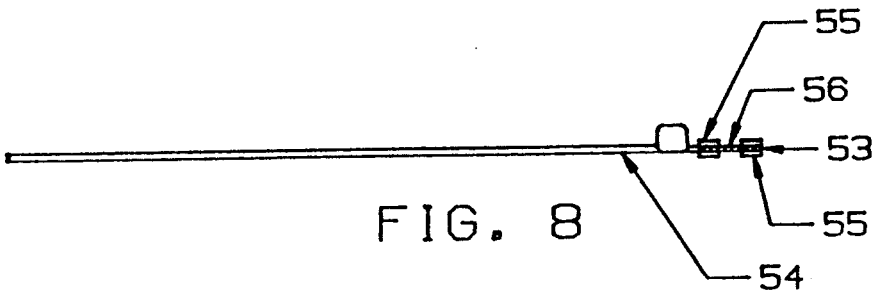
FIG. 8 is a sectional view taken along line 8—8 of FIG. 7.
Figure 21:
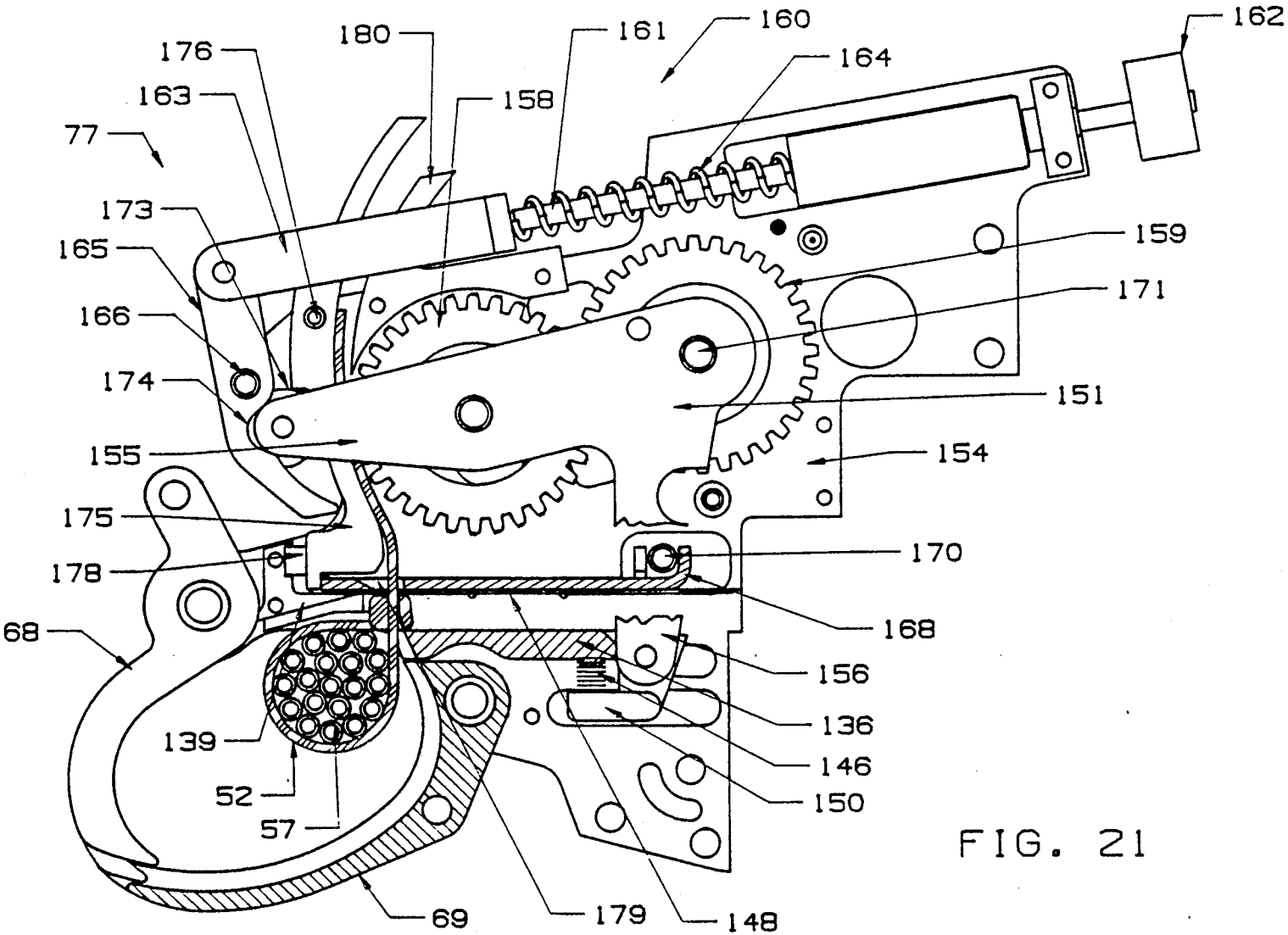
FIG. 21 is a side view, partially in section with a side plate removed showing the cable tie tensioning and severing mechanism of the tool of FIG. with the strap of the cable tie being withdrawn by a gripper gear.
Figure 22:
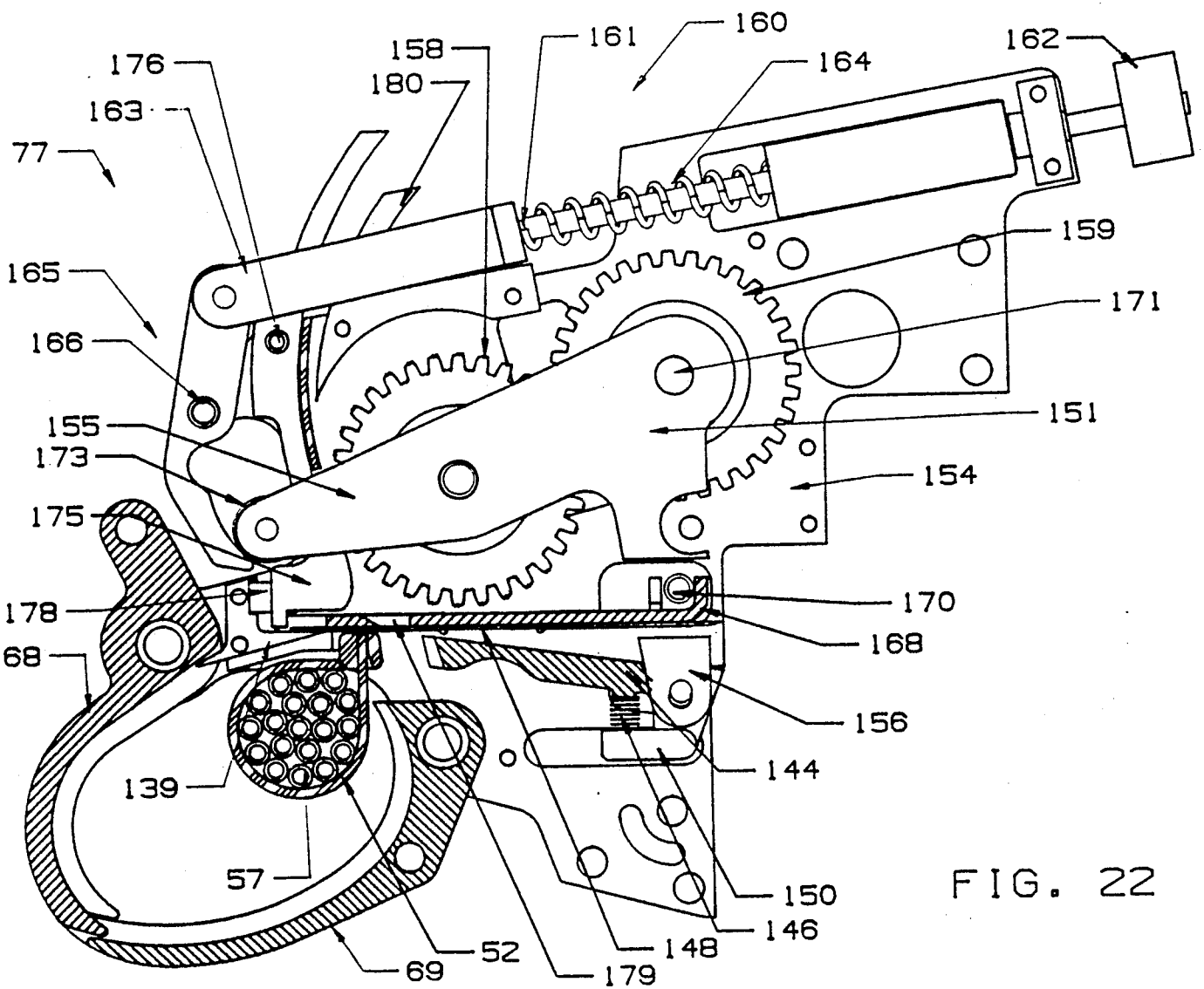
FIG. 22 is a side view similar to FIG. 21 with the mechanism shown in a position after the tensioning mechanism has applied the desired tension to the strap of the cable tie and has pivoted a strap cutoff blade to sever the strap.
Figure 23:
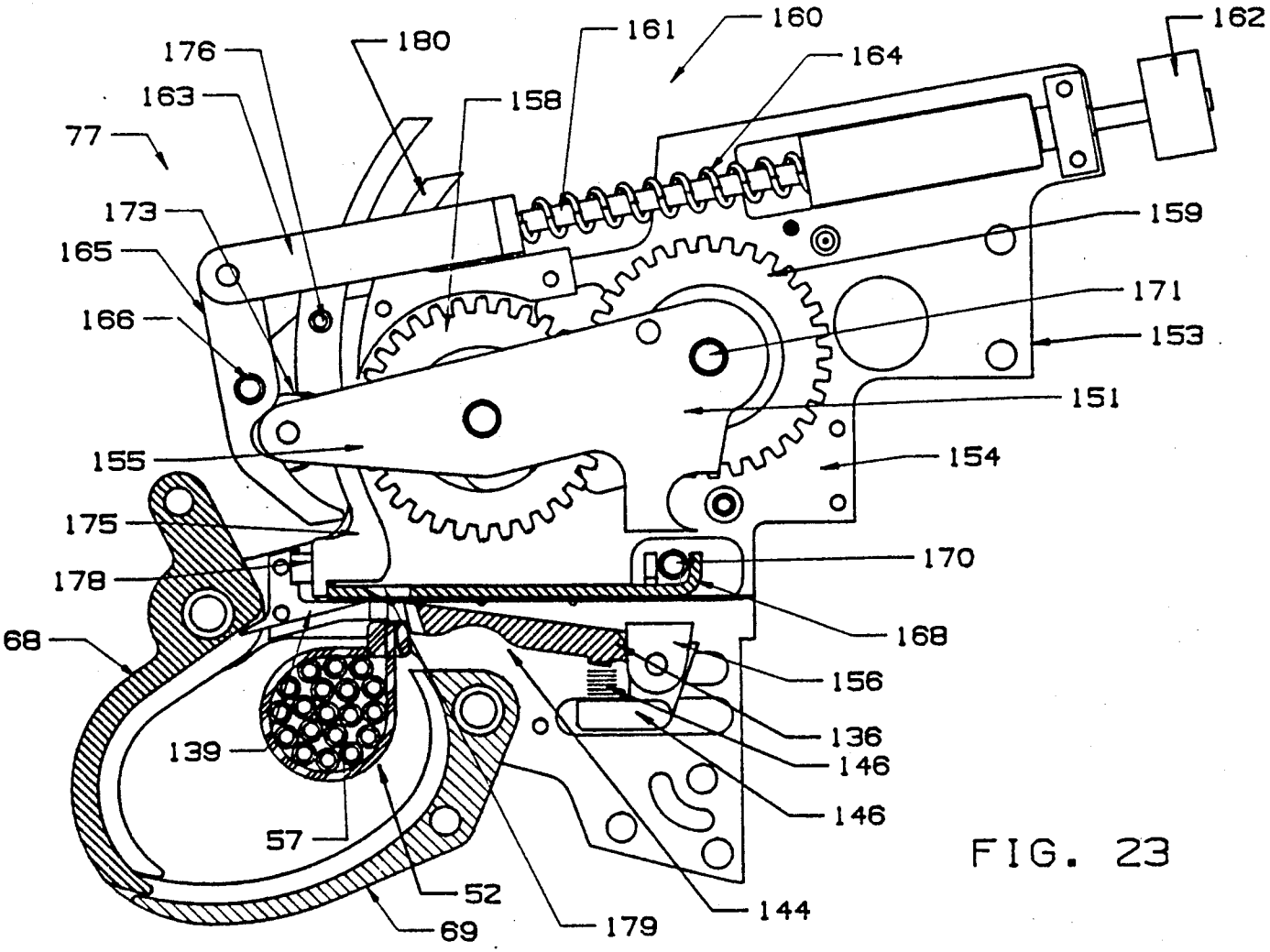
FIG. 23 is a side view similar to FIG. 21 with the mechanism shown in a position just after an ejectioning mechanism ejects the cable tie from the tool.

Tool 50 is designed to apply cable ties where the cable ties are provided in ribbon form by applicants' common assignee, Panduit Corp., which are sold under the name "Continuously Molded, Reel-fed Cable Ties, PLTIM-XMR" and which are described in U.S. Pat. No. 4,498,506 which is incorporated herein by reference. As seen in FIGS. 7 and 8, integrally formed ribbon 51 of cable ties 52 includes a plurality of parallel cable ties individually joined at their heads to a strip portion 53 with the strap 54 of each cable tie extending perpendicular to the length of strip portion 53. Strip portion 53, which extends along the length of the ribbon, includes alignment guides 55 formed on opposite planar surfaces of the strip portion that define an alignment channel 56 for accurately laterally positioning ribbon 51. Tool 50 applies cable ties 52 around wires 57 to form a wire bundle as seen in FIGS. 21–23.

Figure 1:
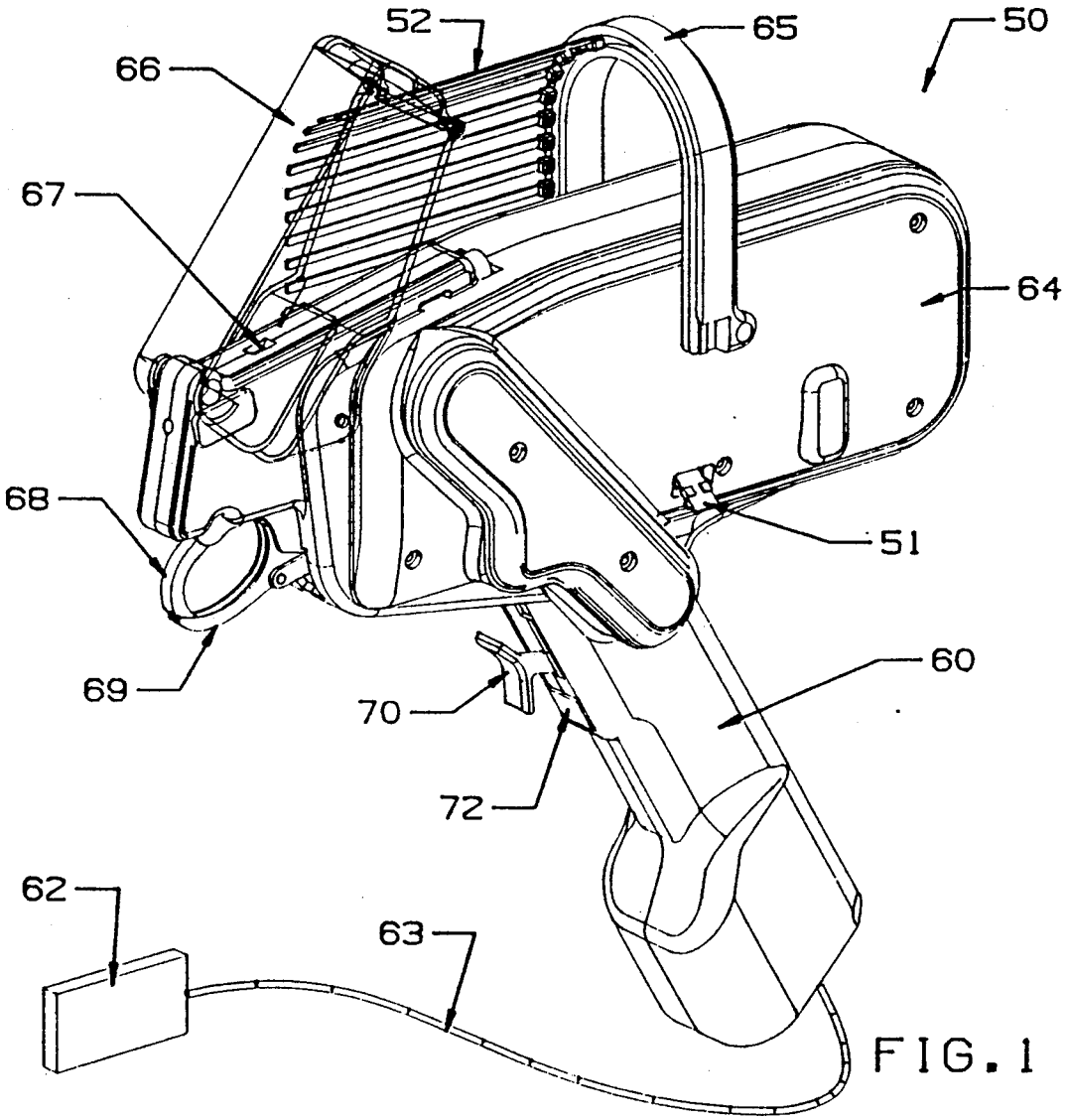
FIG. 1 is a perspective view of a portable cable tie tool embodying the concept of the present invention.

As seen in FIG. 1, Tool 50 generally includes a handle 60 which contains an electric motor 61 (FIG. 4), a portable battery pack 62 which can be carried by the operator of the tool 50 which provides power to the tool through a power cord 63, a tool housing 64 which encloses the working mechanisms of tool 50, a U-shaped cable tie ribbon guide 65, a transparent plastic strap collector 66 that collects severed straps ejected from tool 50 through a tie ejection aperture 67, an upper jaw 68, a lower jaw 69, a lower jaw actuation trigger 70 that opens the lower jaw 69 for positioning around a wire bundle (not shown), and an electric switch 72 that actuates the tool control circuitry for the application of a cable tie 52 by tool 50.

Tool 50 includes the following mechanisms: a cable tie receiver mechanism 74 (FIG. 3) that receives a cable tie ribbon, positions the ribbon, severs the leading cable tie from the ribbon and positions it for subsequent advancement; a cable tie advancing mechanism 75 (FIG. 6) which advances the cable tie from the cable tie receiver mechanism 74; a cable tie positioning, inserting and ejecting mechanism 76 (FIG. 16) which receives the cable tie from cable tie advancing mechanism 75, positions the cable tie around a bundle of wires, inserts the strap of the cable tie through the locking head of the cable tie, and ejects the cable tie head from the tool; and a cable tie tensioning and severing mechanism 77 (FIG. 21) that tensions the cable tie to a predetermined level and severs the excess strap of the cable tie.

Figure 2:
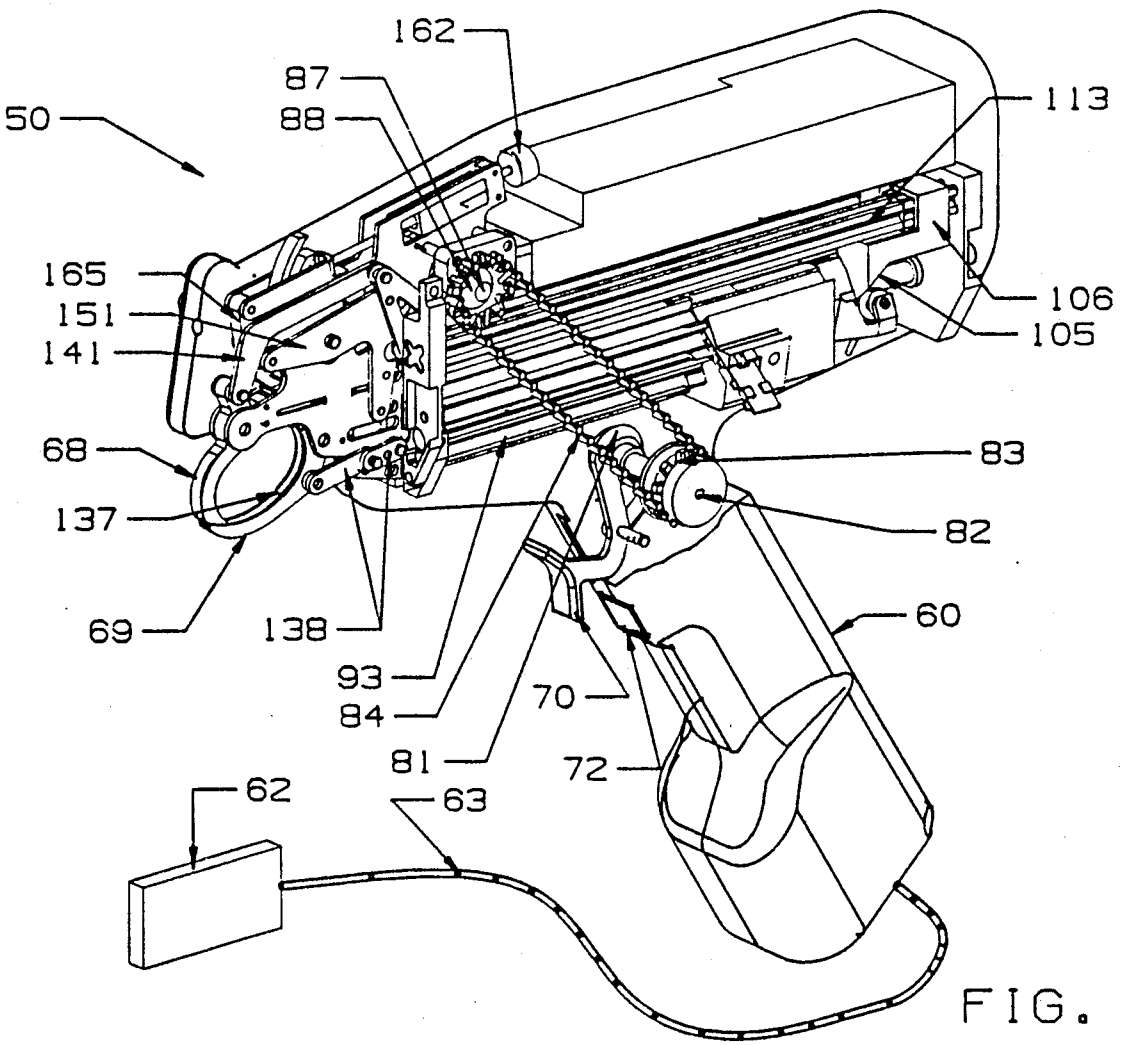
FIG. 2 is a perspective view of the tool of FIG. 1 with portions of the tool's housing removed.
Figure 14:
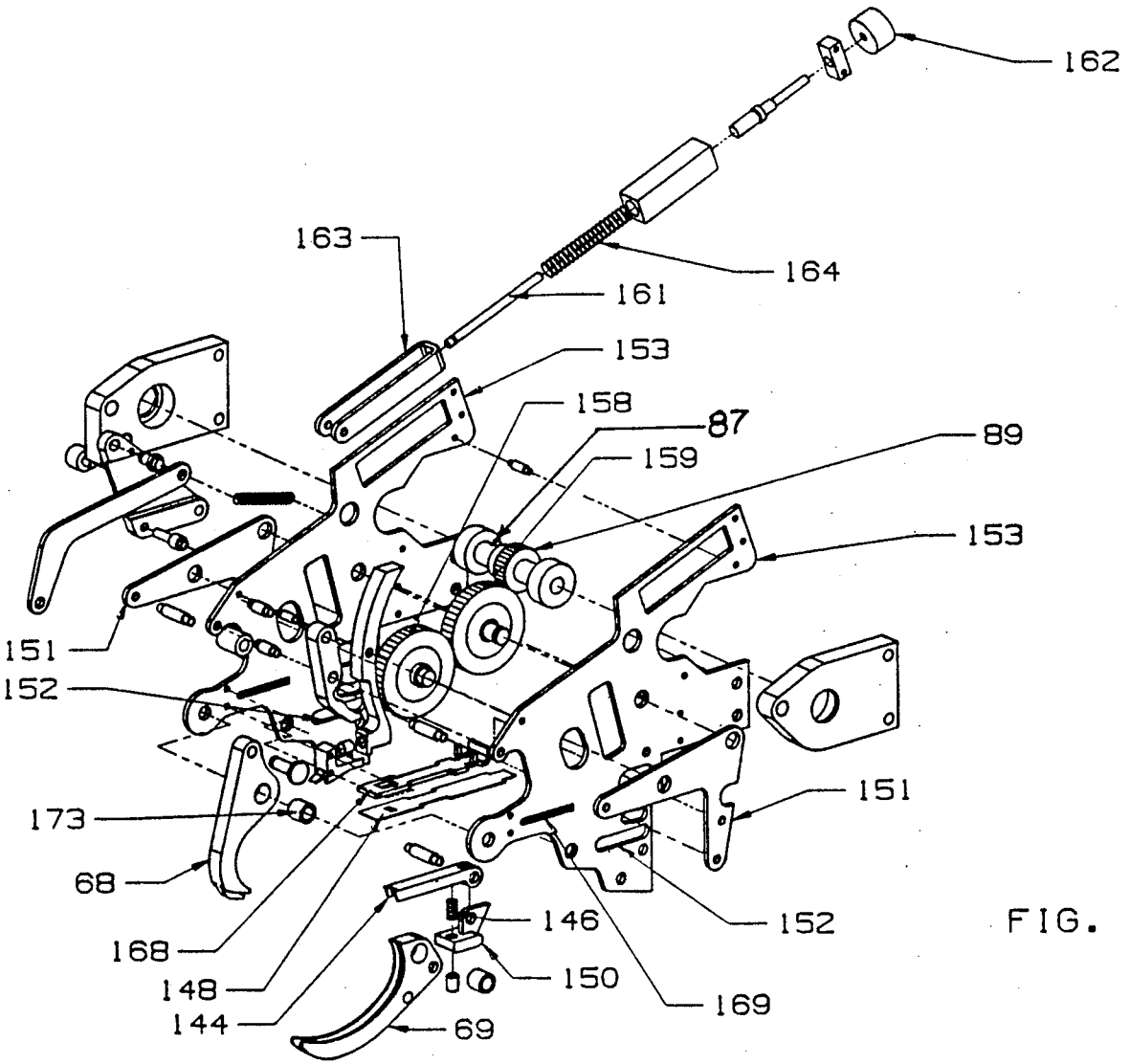
FIG. 14 is an exploded assembly view of a cable tie positioning, inserting and ejecting mechanism and a cable tie severing and tensioning mechanism of the tool of FIG. 1.

The mechanisms of tool 50 are powered by a single electric motor 61 mounted in handle 60 of the tool which reduces the weight and cost, and increases the reliability of tool 50. As seen in FIGS. 2 and 4, motor 61 drives bevel gears 80 and 81 which drives shaft 82 and first drive sprocket 83. Drive chain 84 is driven by first drive sprocket 83 and in turn drives shaft 87 through second drive sprocket 88 mounted to a first end of shaft 87. Shaft 87 mounts a tensioning mechanism drive gear 89 disposed in the interior of tool 50 (FIG. 14) and a carriage drive gear 90 on the opposite end of shaft 87 (FIG. 3) which in turn drives a carriage drive pinion 92.

Figure 3:
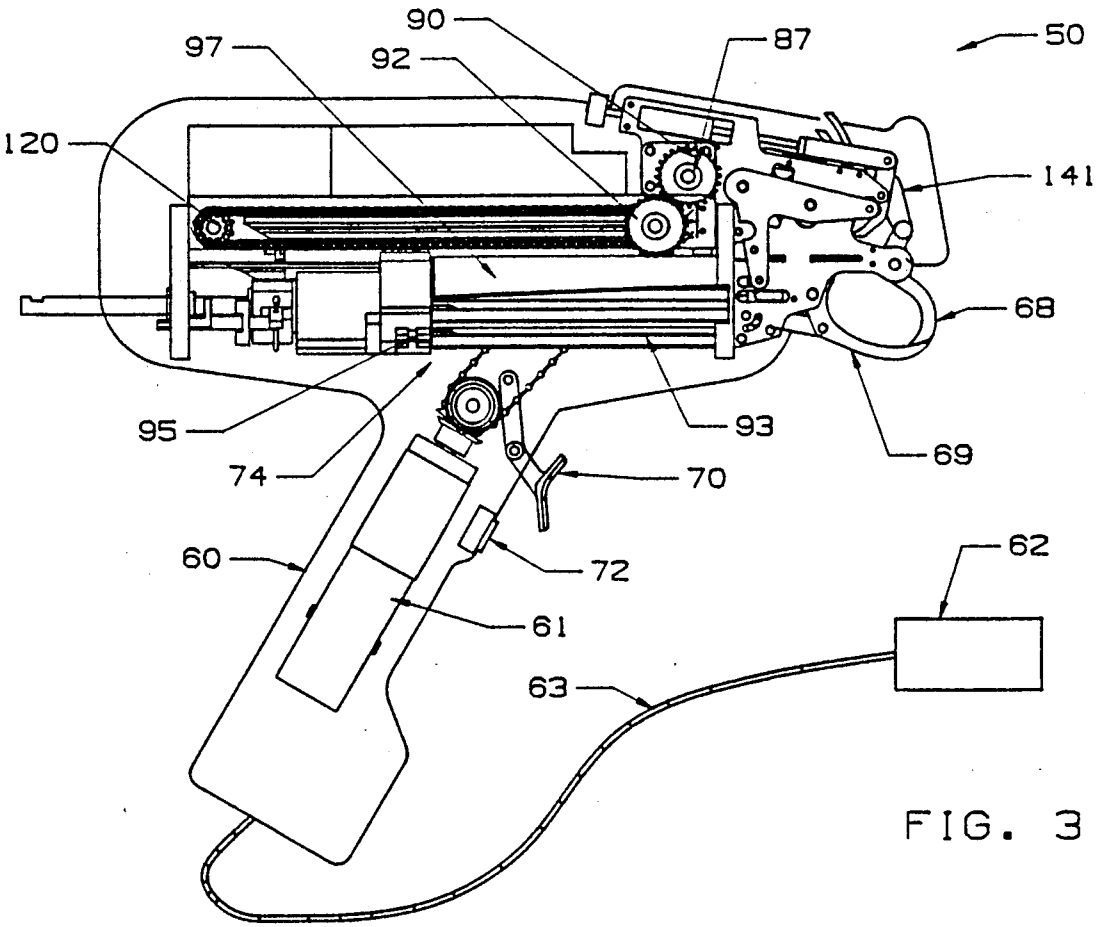
FIG. 3 is a side view of the tool of FIG. 1, with portions of the tool's housing removed, showing a cable tie ribbon entry side of the tool.
Figure 4:
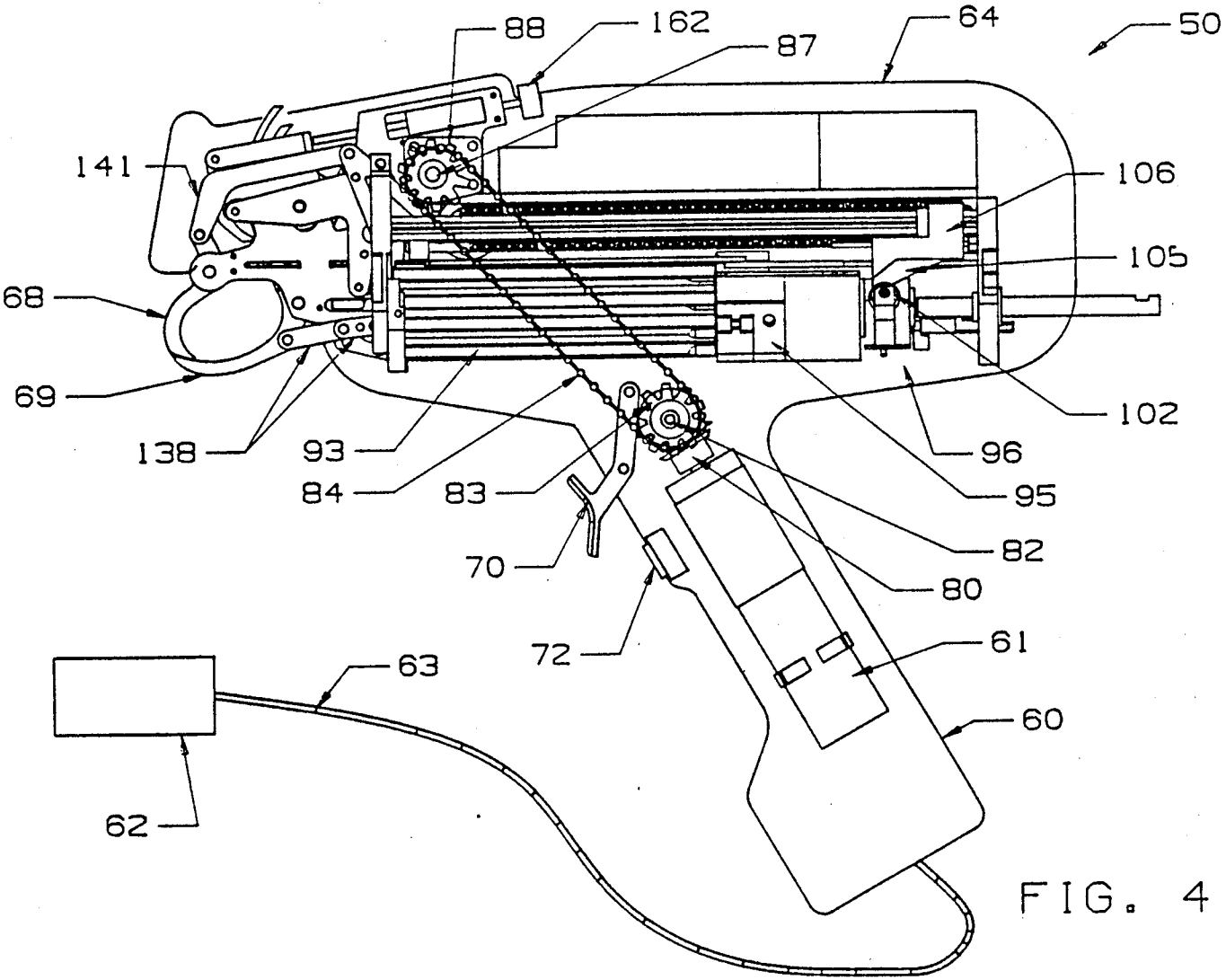
FIG. 4 is a side view of the tool of FIG. 1, with portions of the tool's housing removed, showing a side of the tool where a strip portion of the cable tie ribbon exits the tool.
Figure 5:
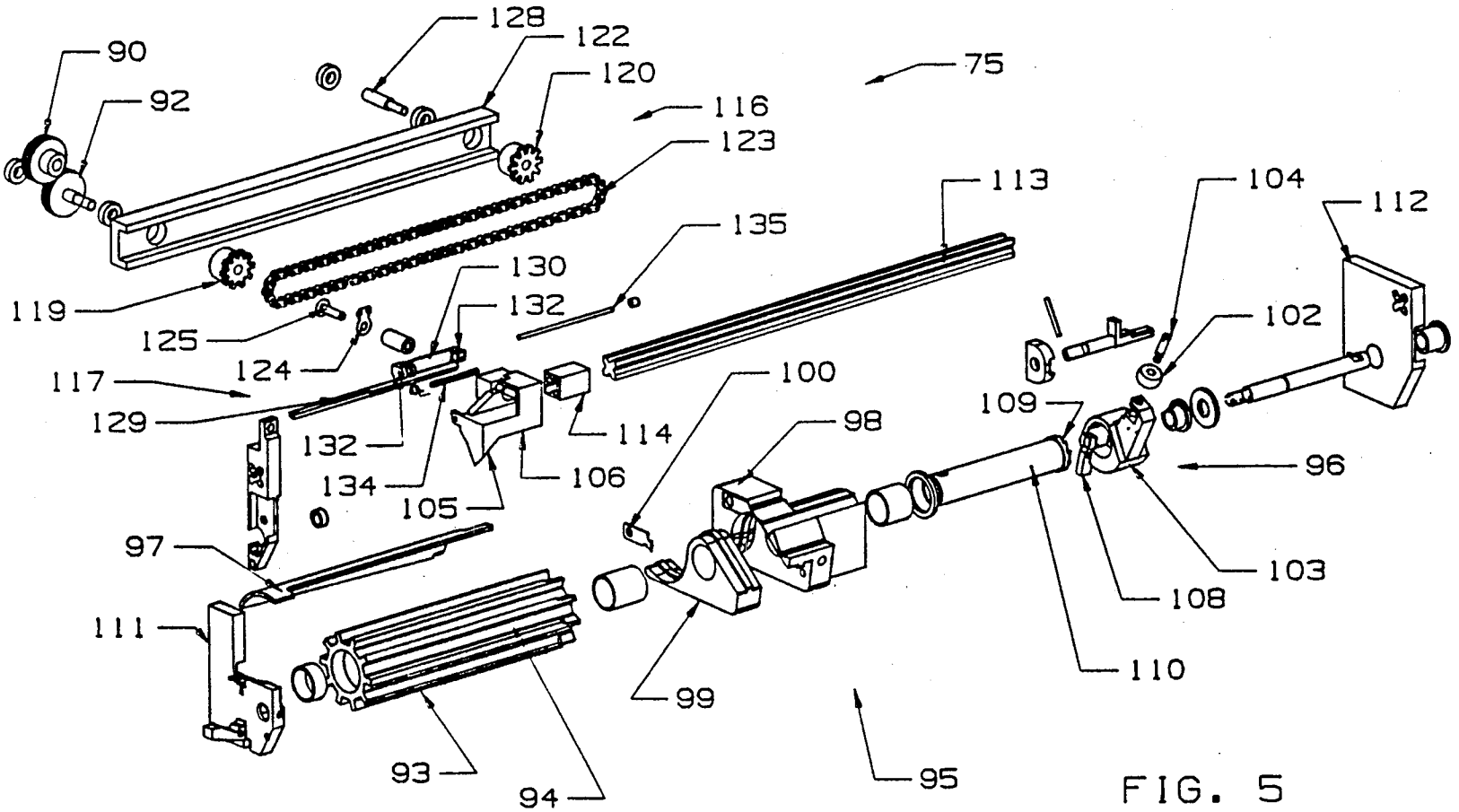
FIG. 5 is an exploded perspective view of a cable tie receiver mechanism and a cable tie advancing mechanism of the tool of FIG. 1.
Figure 9:
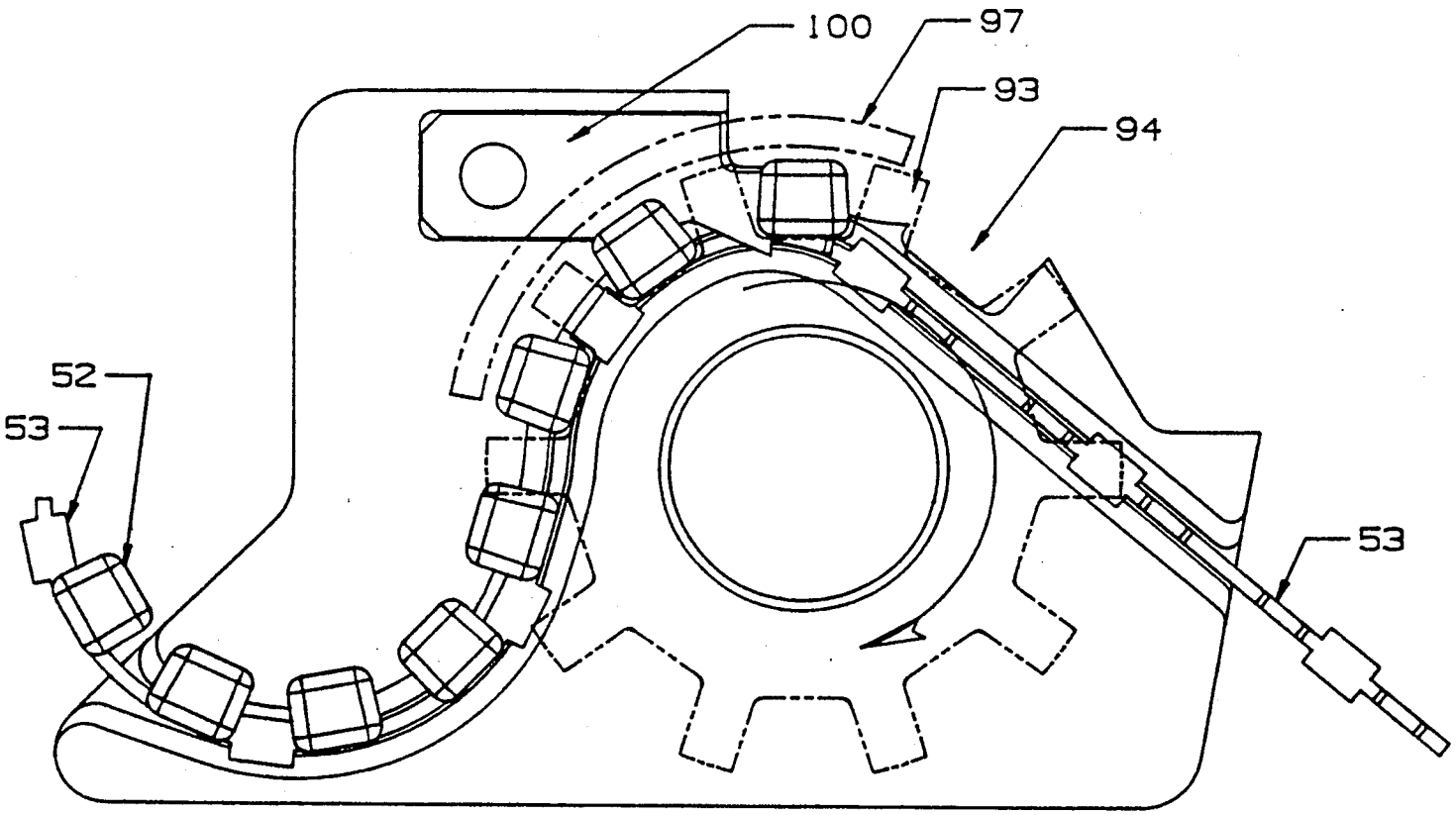
FIG. 9 is a front view of upper and lower guide blocks of the receiver mechanism of the tool of FIG. 1 showing the position of a cable tie receiver drum and a drum cover in phantom with its direction of rotation being shown by an arrow.
Figure 11:
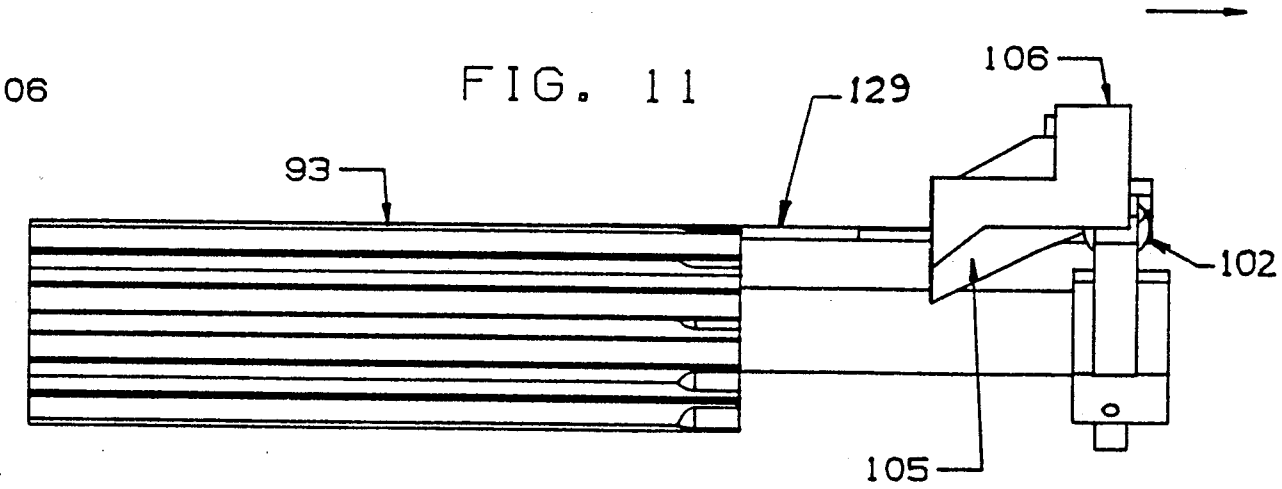
FIG. 11 is a side view of the receiver drum and carriage of FIG. 10 with the carriage initially engaging a ratchet cam roller 102.
Figure 10:
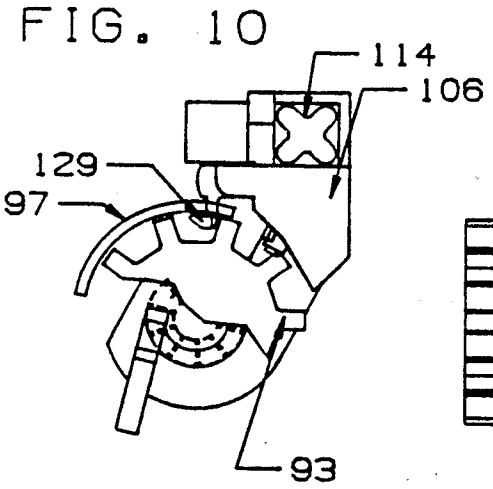
FIG. 10 is a front view of a cable tie receiver drum partially broken away and a carriage with a tie pushing member positioned in the top groove of the receiver drums of the tool of FIG. 1.

As seen in FIGS. 3, 5 and 9, cable tie receiver mechanism 74 includes a rotatably mounted cable tie receiver drum 93 having a plurality of cable tie receiving longitudinal grooves 94, a cable tie strip positioning guide assembly 95 disposed adjacent the rear of receiver drum 93 and a ratchet assembly 96 that is cam actuated to incrementally rotate drum 93 to sequentially position each cable tie positioned in one of grooves 94 for advancement. A cover 97 disposed adjacent drum 93 encloses the upper quarter of grooves 94 to contain cable ties 52 therein.

Guide assembly includes upper and lower guide blocks 98 and 99 that accurately position strip portion 53 of ribbon 51 and a knife blade 100 disposed to sever the leading tie from the strip of the cable tie ribbon as drum 93 is rotated. See above noted U.S. Pat. No. 4,498,506 which discloses a dispenser that utilizes a similar mechanism to sever individual ties from a ribbon of ties.

Ratchet assembly 96 is constructed in a manner known in the art to incrementally rotate cable tie receiver drum 93 a part of a revolution necessary to sequentially position each groove 94 in a position to provide the next cable tie for advancement in tool 50. In general ratchet assembly 96 includes a ratchet cam roller 102 rotatably mounted on a ratchet arm 103 by a screw 104 and disposed to engage a ratchet cam surface 105 of carriage 106. Ratchet arm 103 mounts a pawl 108 disposed to engage teeth 109 formed in a ratchet shaft 110 which is connected to cable tie receiver drum 93 such that when ratchet cam roller 102 is engaged by a ratchet cam surface 105, ratchet arm 103 is rotated downwardly in a clockwise direction as seen in FIG. 2 which engages teeth 109 of a ratchet shaft 110 which is connected to receiver drum 93 to incrementally rotate receiver drum 93. Receiver drum 93 and ratchet assembly 96 are rotatably mounted between front and rear mounting plates 111 and 112 by various bushings, spacers and shafts as is well known in the art.

Figure 6:
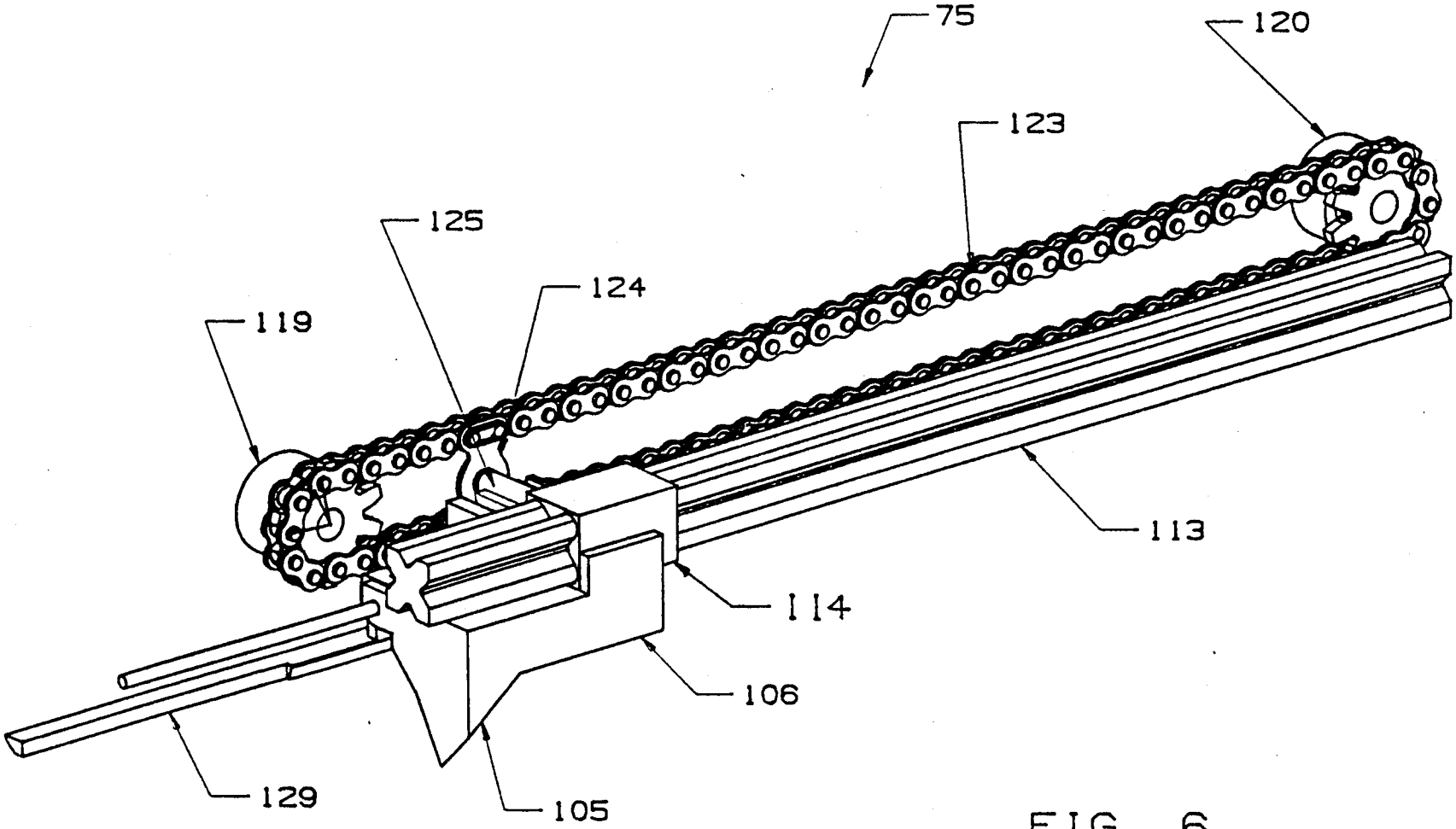
FIG. 6 is a perspective view of the cable tie advancing mechanism of the tool of FIG. 1.

As best seen in FIGS. 5, 6 and 10–13, cable tie advancing mechanism 75 includes carriage 106 slidably mounted on carriage guide shaft 113 by carriage bushing 114, a carriage drive assembly 116 and a cable tie pusher assembly 117. Carriage 106 includes ratchet cam surface 105 for actuating ratchet assembly 96 (FIG. 4) and an insertion cam surface 118 (FIGS. 18 and 20) for actuating the insertion of a cable tie strap within the head of the cable tie. Carriage 106 is mounted for reciprocation along carriage guide shaft 113 which is formed with a X-shaped cross-section (FIG. 6).

Carriage drive assembly 116 includes spaced apart first and second chain carriage sprockets 119 and 120 carried on chain sprocket carrier 122 which together rotatably mount a carriage chain 123. Carriage chain 123 includes a carriage chain link 124 which connects chain 123 to a pin 125 that is spaced inwardly from chain 123 to secure carriage 106 to chain 123 relative to the direction of translation of carriage 106 along guide shaft 113 while allowing free rotation of pin 125 relative to carriage 106 (FIG. 6). Chain link 124 positions the carriage carrying pin 125 in line with a line connecting the axes of first and second carriage chain sprockets 119 and 120, centered between the upper and lower extent of chain 123 such that continuous rotation of chain and chain link in one rotational direction reciprocates carriage in two directions along guide shaft 113 thus allowing the use of a single non-reversible electric motor 61 which reduces the weight, complexity and cost of tool 50. First carriage chain sprocket 119 is driven by carriage drive pinion 92 which is driven by carriage drive gear 90. Second carriage chain sprocket 120 is rotatably mounted on shaft 128.

Figures 17, 18:
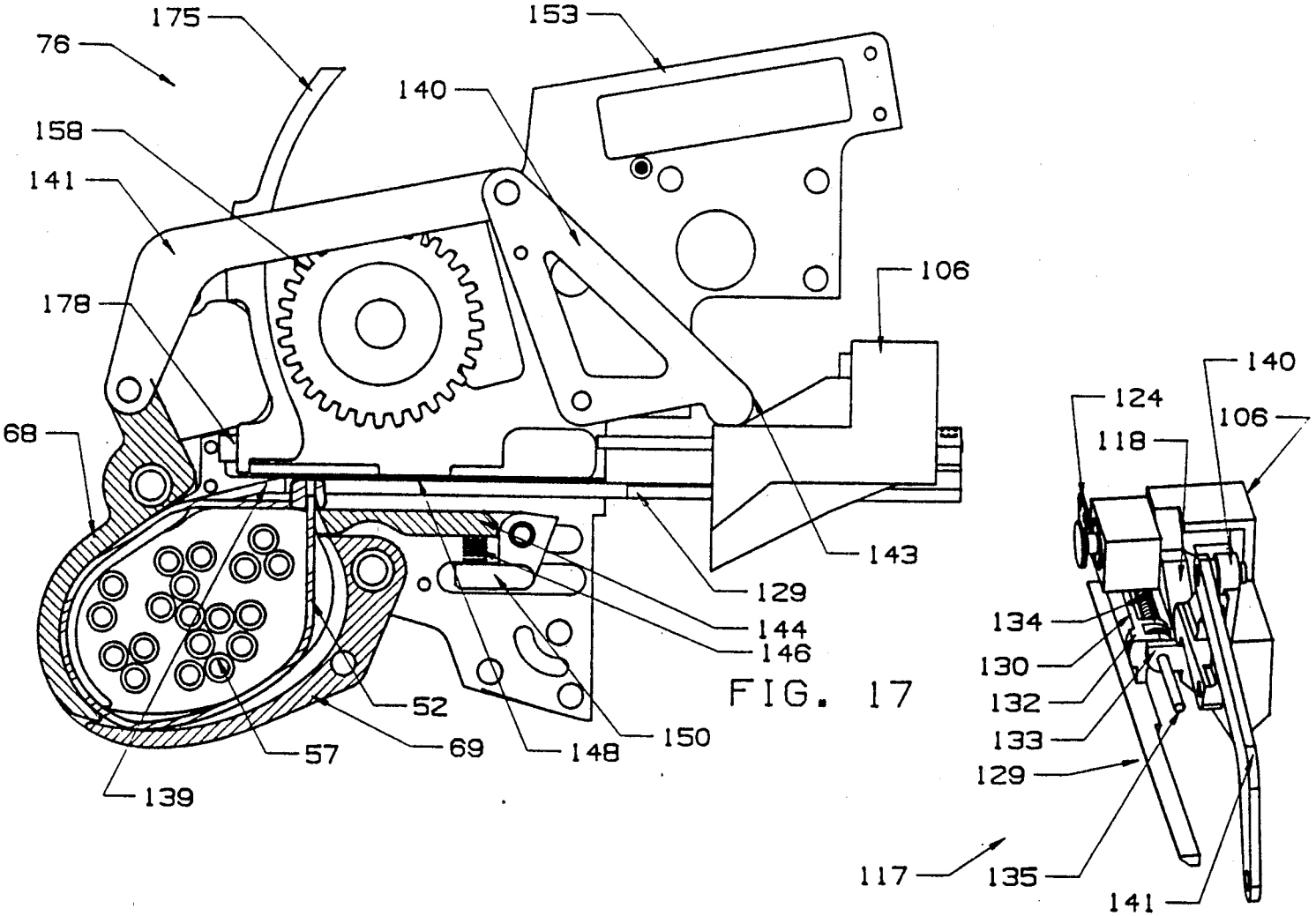
FIG. 17 is a side view similar to FIG. 16 showing a cable tie positioned for insertion of its strap through its locking head.
FIG. 18 is a perspective view of the carriage and the cable tie pushing member of the tool of FIG. 1 shown with a cam surface of the carriage initially engaging a jaw idler link.
Figures 19, 20:
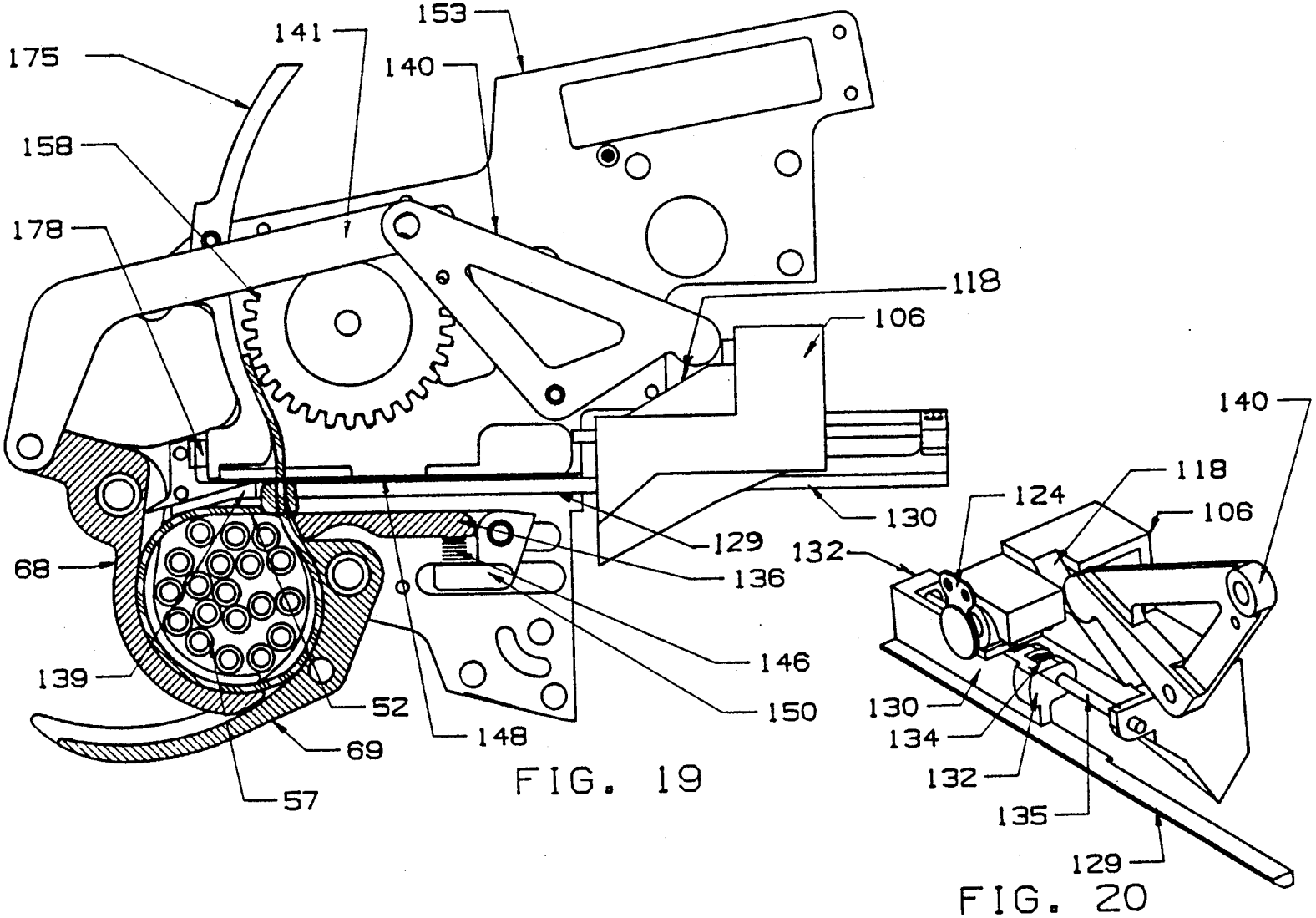
FIG. 19 is a side view similar to FIG. 16 showing the advanced carriage actuating jaw idler link to pivot the upper jaw inward and insert the strap of the cable tie through the head of the cable tie.
FIG. 20 is a perspective view similar to FIG. 18 showing the jaw idler link actuated by the cam surface of the carriage.

Cable tie pusher assembly 117 includes an elongate tie pushing member 129 having a mounting bracket 130 that presents spaced apart pin mounting flanges 132 (FIGS. 18 and 20). Mounting bracket 130 of pushing member 129 fits within pin mounting flanges 133 of a corresponding bracket formed on carriage 106 such that assembly of a spring 134 between flanges 132 and 133 and insertion of pin 135 through the flanges and spring 134 resiliently mounts pushing member 129 relative to carriage such that pushing member 129 can be resiliently compressed inwardly with respect to carriage 106.

Pushing member 129 is disposed to align with a top groove of cable tie receiver drum 93, as seen in FIGS. 10–13, such that reciprocation of carriage 106 advances the leading cable tie from cable tie receiver drum 93 to the cable tie positioning, inserting and ejecting mechanism 76.

Figure 15:
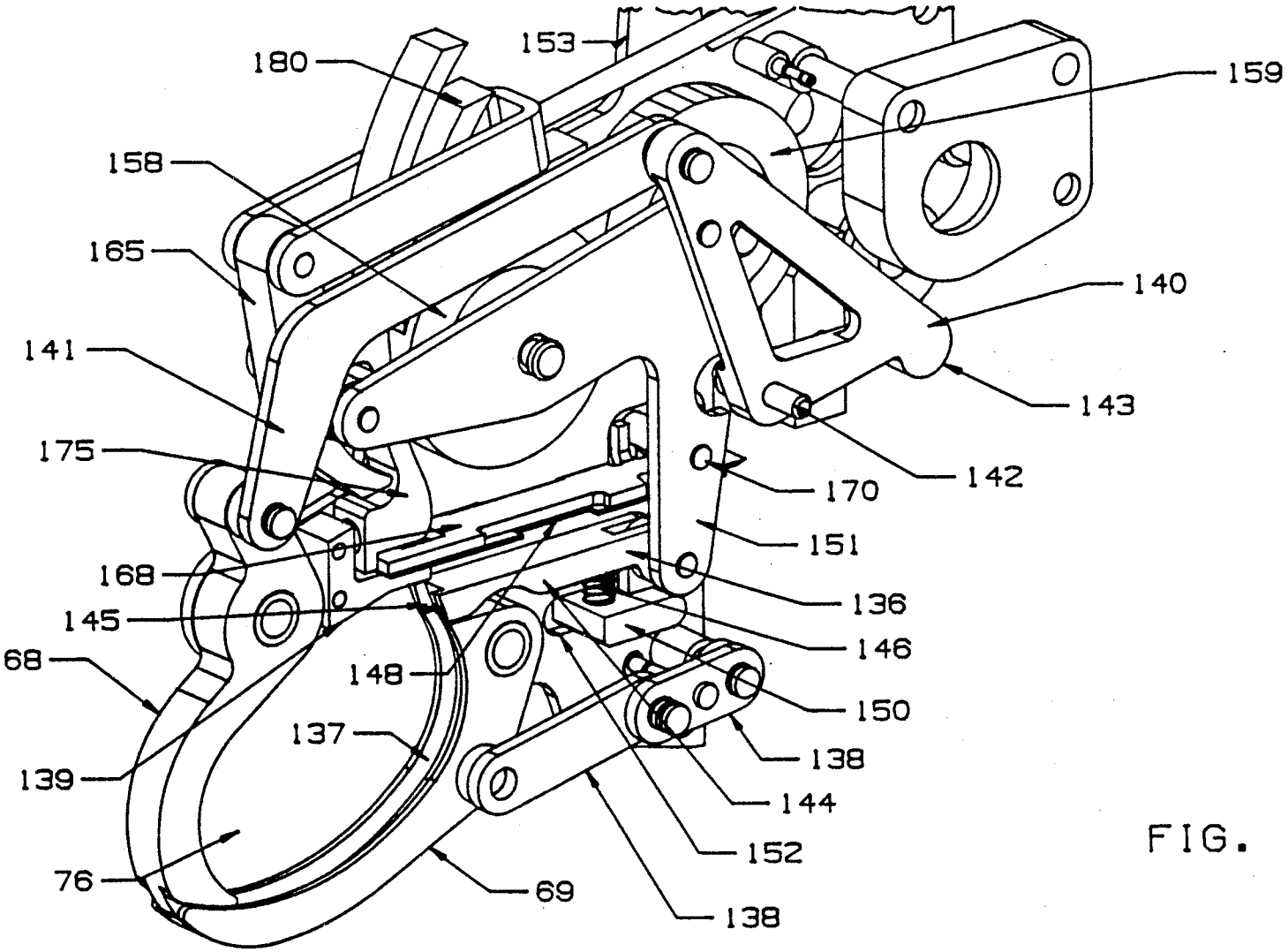
FIG. 15 is a fragmentary perspective view of the cable tie positioning, inserting and ejecting mechanism of the tool of FIG. 1.
Figure 16:
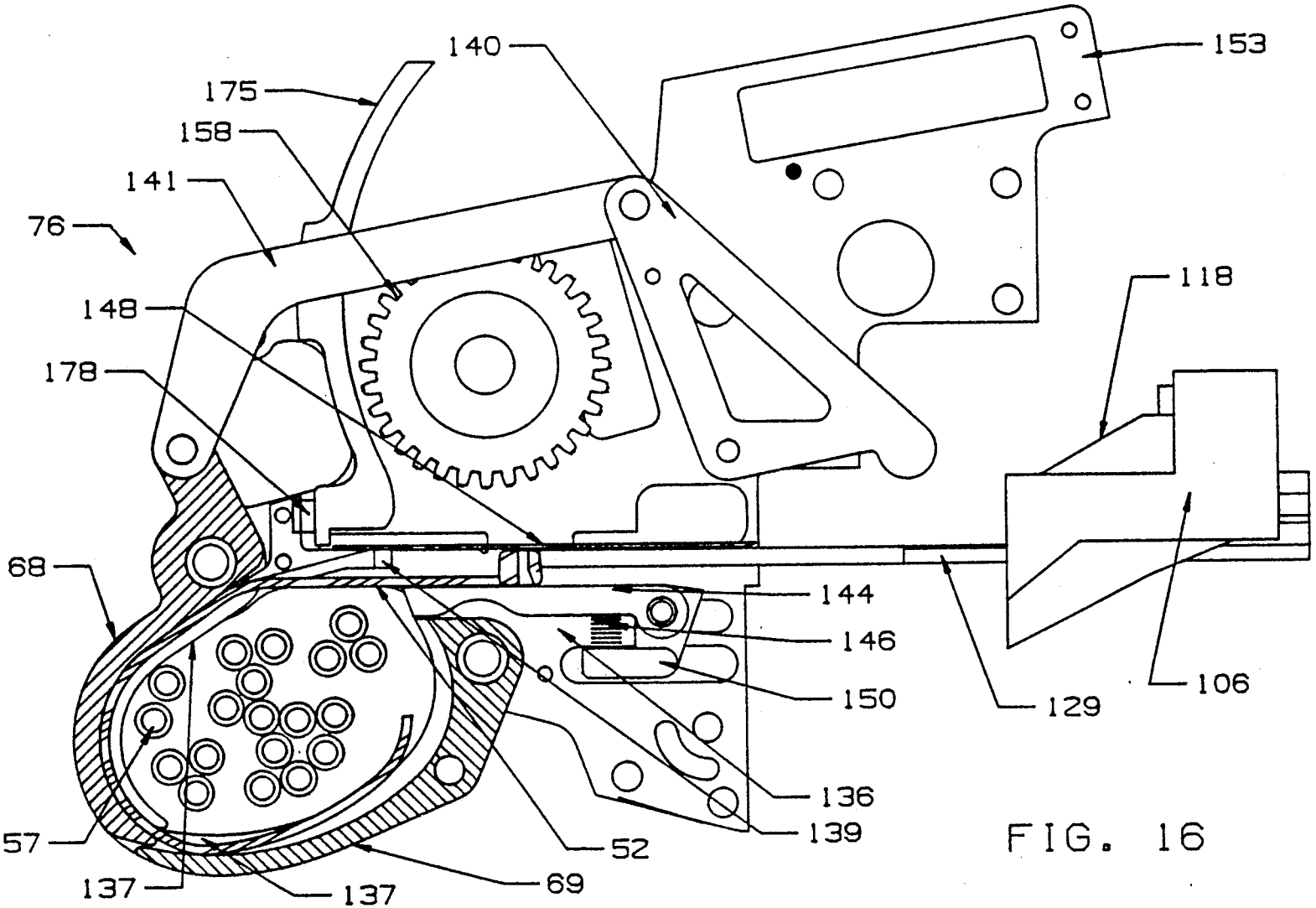
FIG. 16 is a side view, partially in section with a side plate removed to more clearly show the mechanisms of the tool, of the cable tie positioning, inserting and ejecting mechanism of the tool of FIG. 1 showing a cable tie being inserted into the jaws by the cable tie advancing mechanism.

As seen in FIGS. 15 and 16, cable tie positioning, inserting and ejecting mechanism 76 includes upper and lower jaws 68 and 69 and a cable tie head retainer and ejector 136. Upper and lower jaws 68 and 69 have aligned internal circumferential grooves 137 that accept a cable tie advanced strap first from the cable tie pusher assembly 117 and guides the strap around the wires to be fastened in a bundle. A head stop 139 is positioned in the line of advance of cable tie 52, allowing passage of the strap of cable tie 52 while stopping the forward movement of the head of cable tie 52. Lower jaw 69 is pivotally mounted to tool 50 and connected through a series of links 138 (FIG. 2) to trigger 70 by a cable (not shown) positioned in handle such that actuation of trigger 70 opens lower jaw 69 allowing upper and lower jaws 68 and 69 to be positioned around the wires. As best seen in FIG. 15, upper jaw 68 is pivotally mounted to the frame of tool 50 and pivotally connected to jaw idler link 140 by link 141. Jaw idler link 140 is pivotally mounted at pin 142 such that rotation of rounded cam edge 143 counter clockwise extends link 141, pivoting upper jaw 68 counter clockwise, within lower jaw 69 to thread the strap of a cable tie positioned in jaws through the head of the cable tie for withdrawal by cable tie tensioning and severing mechanism 77.

Cable tie head retainer and ejector 136 is a pivotally mounted retainer member 144 having a cable tie distal positioning groove 145 formed in its free end. Retainer member 144 is resiliently biased upwardly by spring 146. Retainer member 144 is disposed within tool 50 to present its upper surface adjacent to and in alignment with the path of a cable tie advanced by the cable tie advancing mechanism such that retainer member 144 resiliently engages the head of the cable tie to trap it against upper tie guide 148. Retainer member is mounted to align distal positioning groove 145 with groove 137 of lower jaw 69 to direct the tip of a cable tie into the head of the cable tie held by retainer member. As seen in FIG. 15, retainer member 144 is pivotally connected to a head retainer guide 150 and left and right gripper assembly linkages 151. Head retainer guide 150 is slidably mounted in opposed slots 152 (FIG. 14) in left and right gripper assembly side plates 153 allowing forward and rearward translation of head retainer guide 150 and attached retainer member 144 in conjunction with the movement of gripper assembly linkages 151.

As seen in FIGS. 15, 21, 22 and 23, cable tie tensioning and severing mechanism 77 includes a gripper assembly 154 having left and right gripper assembly linkages 151 having a forward arm 155 and a downwardly projecting rearward arm 156 which respectfully rotatably mount therebetween, meshing gripper gear 158 and intermediate gear 159; an adjustable tension assembly 160 having a yoke rod 161 secured to tension adjusting knob 162 received in a threaded yoke 163 and biased away from yoke 163 by spring 164, with yoke 163 being connected to a detent cam 165 pivotally mounted in side plates 153 by a pin 166; and a strap cut off blade 168 slidably mounted in slots 169 of side plates 153 (FIG. 14) which is operatively connected by pin 170 to rearward arms 156.

Left and right gripper assembly linkages 151 are disposed outwardly of side plates 153 and pivotally mounted to side plates 153 by the axel 171 of intermediate gear 159; apertures being provided in side plates 153 allowing pivotal movement of gripper assembly 154 relative to side plates 153. FIGS. 15–17, 19, 21–23 have the closest side plate removed to show the mechanisms of tool 50. A detent cam follower 173 is rotatably mounted to and between the distal ends of forward arms 155 and disposed to be engaged in detent 174 of detent cam 165.

Disposed adjacent gripper gear 158 is gripper backstop 175 which is pivotally mounted by pin 176. Resilient urethane spacer 178 allows limited pivotal forward movement of the lower end of gripper backstop 175. The lower free end of backstop 175 is aligned with a strap accepting slot 179 in strap cutoff blade 168 such that the tip of a cable tie inserted through slot 179 is guided by backstop 175 into engagement with gripper gear 158. A strap guide plate 180 is disposed adjacent to and spaced from gripper backstop 175 which together direct a severed strap outwardly through tie ejection aperture 67.

Electric motor 61 drives all of the working mechanisms of tool 50 directly providing motive power through drive chain 84 to shaft 87 which powers cable tie advancing mechanism 75 to reciprocate carriage 106 through chain drive assembly 116; directly driving gripper assembly 154 to tension each cable tie through tensioning mechanism drive gear 89; indirectly providing motive power to rotate cable tie receiver drum 93 by cam actuation of ratchet assembly 96 by reciprocating carriage 106; indirectly actuating upper jaw 68 by cam actuation of jaw idler link 140 by reciprocating carriage 106; and indirectly driving strap cutoff blade 168 and retainer member 144 by the pivotal actuation of gripper assembly 154.

Tool 50 is operated as follows. As seen in FIG. 1, a cable tie ribbon 51 is inserted into a track of U-shaped ribbon guide 65 which guides the ribbon 51 into cable tie strip positioning guide assembly 95 and cable tie receiver drum 93, best seen in FIG. 3. Although the use of guide 65 is preferred tool 50 can be operated without the guide by merely inserting a strip of ribbon 51 into assembly 95 and drum 93.

The leading cable tie of ribbon 51 is positioned in a groove 94 and advanced past knife blade 100 to sever it from strip portion 53 to a position at the top of cable tie receiver drum 93 where it is aligned with tie pushing member 129 by cycling tool 50. See FIGS. 9–13.

Lower jaw 69 is then opened and placed around the objects to be fastened by pressing trigger 70.

Switch 72 is then pressed to actuate control circuitry of tool 50 (not shown) to start a full cable tie application cycle.

Figure 13:
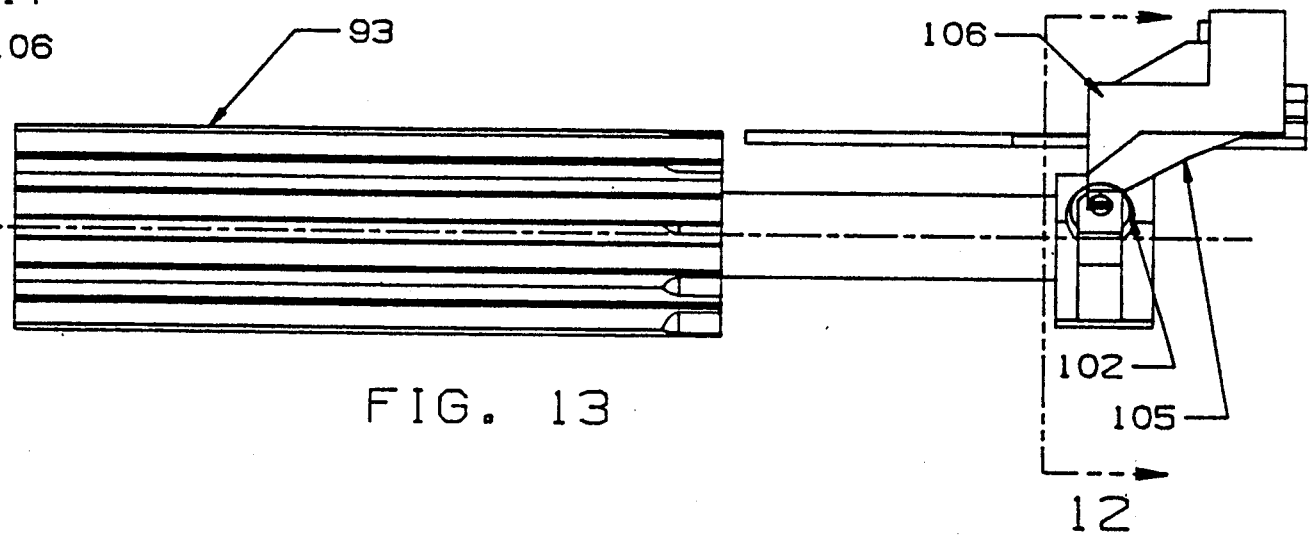
FIG. 13 is a side view of the receiver drum and carriage of FIG. 12 with the carriage positioned in its most fully retracted position.
Figure 12:
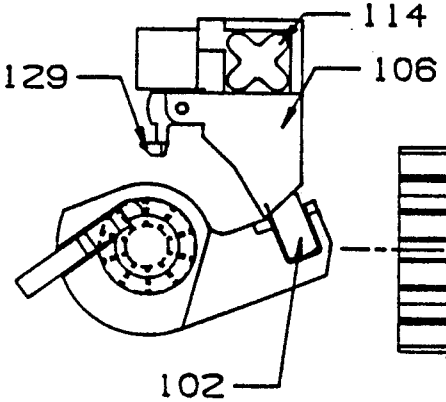
FIG. 12 is a sectional view taken along line 12—12 of FIG. 13.

At the beginning of each cycle carriage 106 is positioned at a fully retracted position as seen in FIG. 13 with carriage chain link 124 best shown in FIG. 6 being positioned adjacent the outermost edge of second carriage chain sprocket 120. As seen in FIG. 13, in this position tie pushing member 129 is withdrawn from and aligned with the top groove 94 in receiver drum 93. With the initiation of the tool cycle electric motor 61 is actuated and is powered continuously throughout the cycle.

Motor 61 thus advances carriage 106 along carriage guide shaft 113 tie pushing member 129 pushing a cable tie contained in the top groove of receiver drum 93 forward into cable tie positioning, inserting and ejecting mechanism 76, see FIG. 16. Tie pushing member 129 advances the strap of cable tie 52 into aligned groove 137 in upper and lower jaws 68 and 69 which guides the strap around wires 57 to be bundled and directs the tip of strap upwards as seen in FIG. 16. As seen in FIG. 17, cable tie 52 is advanced until its head abuts head stop 139 which accurately positions the head of cable tie 52 for insertion of the strap; retainer member 144 resiliently biasing the head of cable tie 52 upwardly against upper tie guide 148 to secure the head of cable tie 52 in position. As seen in FIG. 15, retainer member 144 includes a groove 145 in its distal end aligned with groove 137 of lower jaw 69 and the aperture of cable tie 52 that guides the tip of the cable tie 52 into its head.

As carriage 106 is advanced further, see FIG. 18, insertion cam surface 118 on carriage 106 (FIG. 20) engages jaw idler link 140 to pivot link 140 and connected link 141 to pivot upper jaw 68 upwardly, driving the strap of cable tie 52 through its head through slot 179 in cutoff blade 168 (FIG. 21) and into engagement with gripper gear 158 of cable tie tensioning and severing mechanism 77. As seen in FIGS. 17–20, tie pushing member 129 is resiliently mounted to carriage 106 such that after the head of cable tie 52 abuts head stop 139 (FIGS. 17 and 18), continued forward Motion of Carriage 106 resiliently compresses pushing member 129 against spring 134, thus limiting the force applied to cable tie 52 and effecting lost motion mounting for pushing member 129.

As best seen in FIGS. 21–23, the tip of cable tie 52 directed into engagement with gripper gear 158 is driven against gripper backstop 175 by gripper gear 158 which continuously rotates in a clockwise direction to apply tension to the strap of the cable tie and tightened it around wires 57. Backstop 175 is pivotally mounted by pin 176 and resiliently supported at its lower end for limited clockwise movement by resilient spacer 178, which provides a tension assembly that is less sensitive to varying tolerances between the strap thickness of cable ties and gripper assembly 154.

Tension assembly 160 applies a preset force to detent cam follower 173 such that as gripper gear 158 withdraws the strap of cable tie 52, increasing the downward force applied to forward arms 155 of left and right gripper assembly linkages 151 a point is reached where the downward force overcomes the force applied by tension assembly 160 which pivots left and right gripper assembly linkages 151 counterclockwise around axel 171. As seen in FIGS. 21 and 22 counterclockwise movement of rearward arms 156 simultaneously retracts strap cutoff blade 168 to sever the strap of cable tie 52 and retracts head retainer member 144, with the distal end being withdrawn past the rearward edge of the head of cable tie 52 such that spring 146 resiliently drives head retainer guide 150 upwardly behind the head of cable tie 52.

Severance of the strap releases the downward force on forward arms 155 and left and right gripper assembly linkages 151, driven by the force applied to cam follower 173 by tension assembly 160 pivot in a clockwise direction back to its starting position which concurrently advances retainer member to push the head of cable tie 52 outwardly and eject it from tool 50.

Continued rotation of gripper gear 158 drives the severed strap between gripper backstop 175 and guide plate 180 which direct the strap out the ejection aperture 67 (FIG. 1).

As best seen in FIGS. 10–13 continued rotation of carriage chain 123 retracts carriage 106 until ratchet cam surface 105 engages ratchet cam roller 102 of ratchet assembly 96 which incrementally rotates cable tie receiver drum 93 severing the next connected cable tie from ribbon 51 and positioning the next cable tie 52 in alignment with tie pushing member 129. The control circuitry includes a sensor that senses the full retraction of carriage 106 and turns motor 61 off to complete the tool cycle.

The actuation of all of the tool mechanisms by the reciprocation of carriage 106 by the chain driver cable tie advancing mechanism 75 provides a means for highly accurate sequential timing of the interacting individual tool mechanisms which can be cost effectively manufactured to produce a relatively light weight portable tool of approximately 3 lbs. of reduced complexity and increased reliability.

Figure 24:
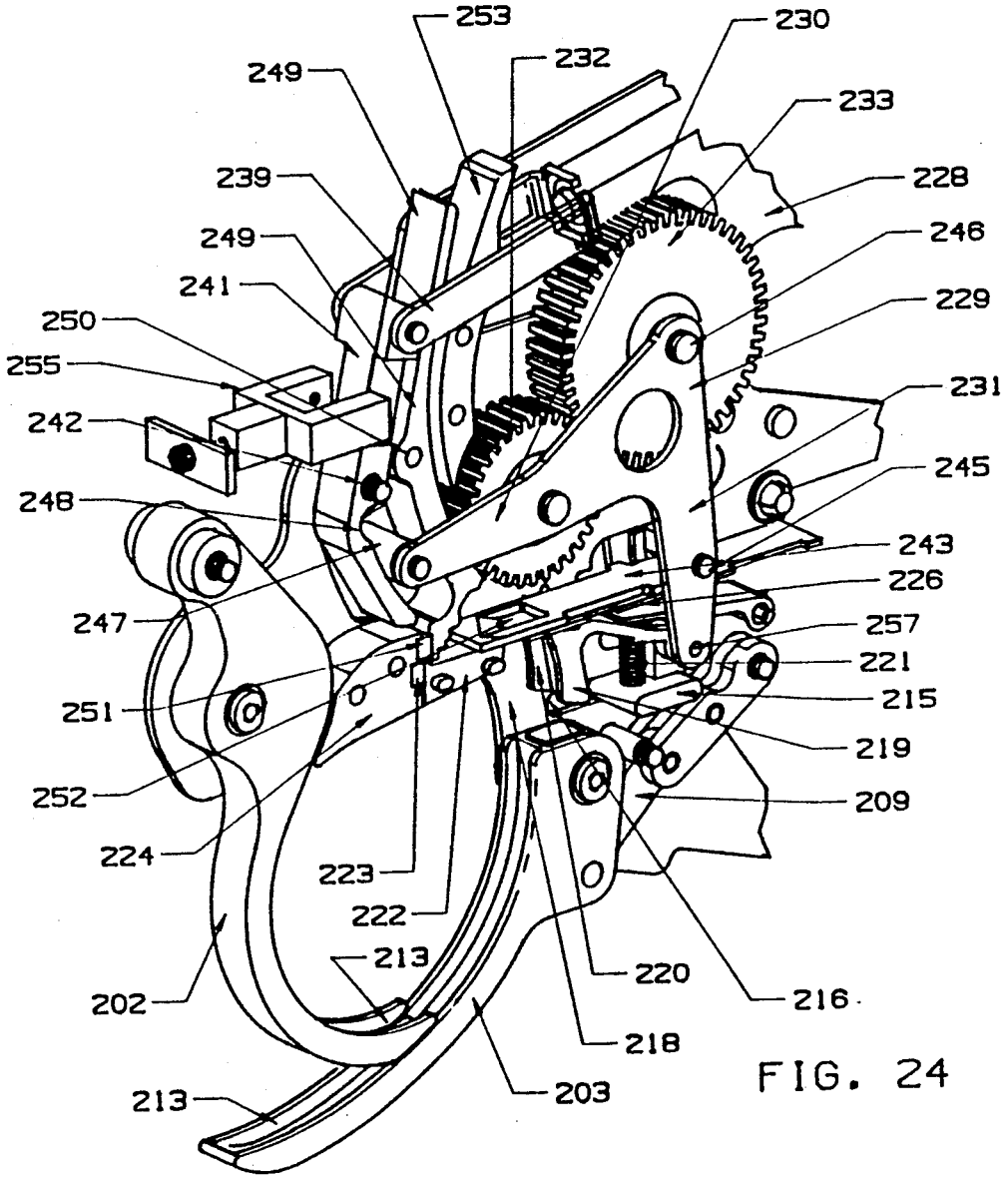
FIG. 24 is a fragmentary perspective view of a second embodiment of a cable tie positioning, inserting and ejecting mechanism for a tool that pneumatically advances a cable tie to the mechanism.
Figure 25:
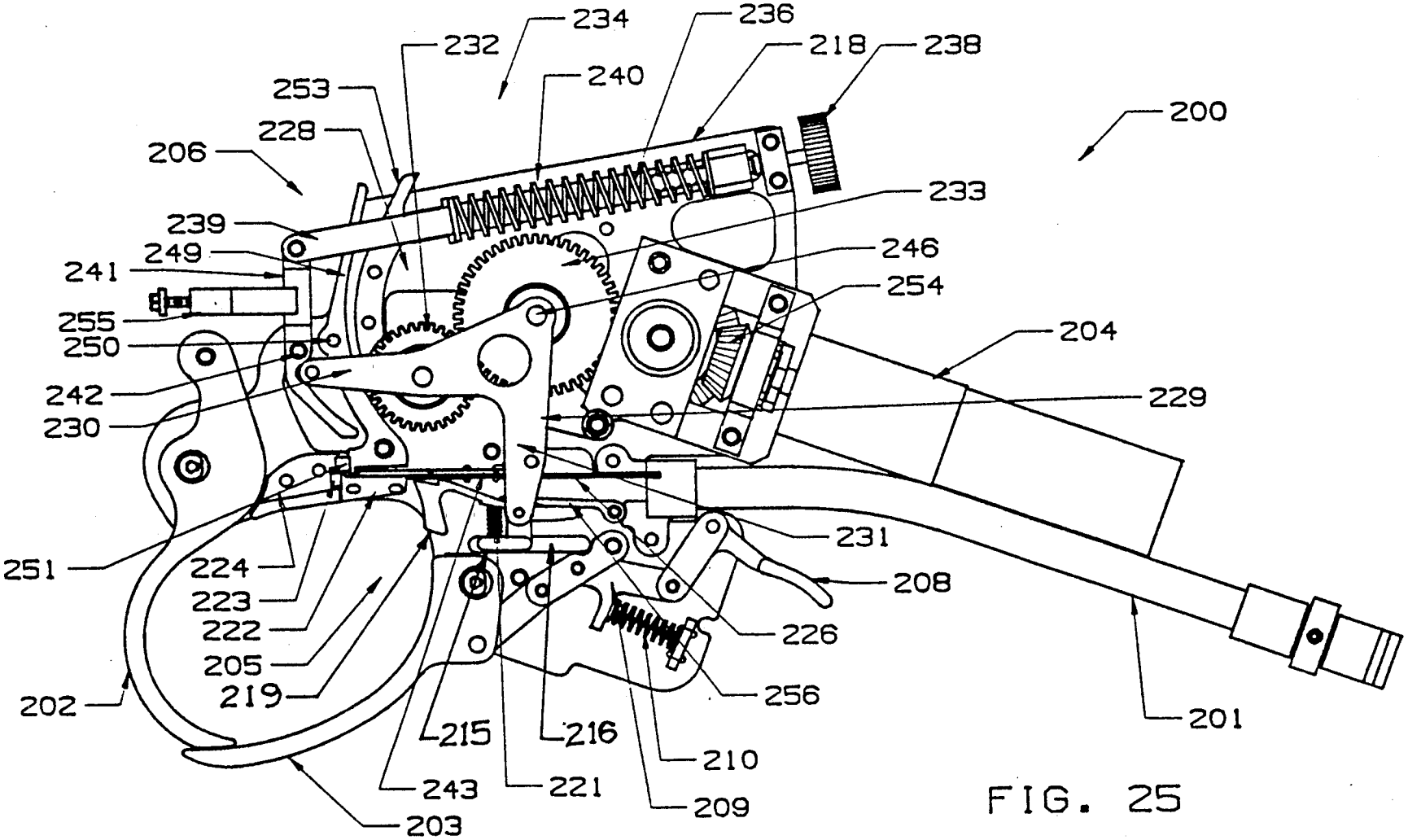
FIG. 25 is a side view of the mechanism of FIG. 24 with a side plate removed to more clearly show the mechanisms of the tool.

FIGS. 24–25 illustrate a second embodiment of the cable tie positioning, inserting and ejecting mechanism 76 and cable tie tensioning and severing mechanism 77 of the present invention as modified to apply individual cable ties pneumatically propelled at high velocity to tool 200 through pneumatic tube 201 from a dispenser as taught in U.S. Pat. No. 4,498,506 which is incorporated herein by reference.

Tool 200 of FIGS. 24–25 is designed to receive individual cable ties of a larger "S" or standard size than the "M" or miniature size utilized in prior tools, which due to their greater mass, are more difficult to stop and position within tool 200 for subsequent tensioning and ejection from tool 200 without suffering impact induced damage to the locking mechanism within the heads of the "S" size cable ties.

Individual "S" or standard size cable ties are approximately 7 inches (18 centimeters) in length and weigh approximately 1.31 grams while "M" or miniature cable ties are approximately 3.9 inches (10 centimeters) in length and weigh approximately 0.27 grams.

Tool 200 includes upper jaw 202, lower jaw 203, electric motor 204, cable tie braking, positioning, inserting and ejecting mechanism 205, and cable tie tensioning and severing mechanism 206. Lower jaw 203 is pivotally mounted and is connected to actuation handle 208 by link assembly 209 which can be opened to position jaws 202 and 203 around a wire bundle. Spring 210 biases link assembly 209 to the closed position. Upper jaw 202 is pivotally mounted and is actuated (FIG. 29) by pneumatic cylinder 211 through link 212 to insert a cable tie strap through its head as described above for tool 50. Jaws 202 and 203 include inner circumferential cable tie positioning grooves 213.

As seen in FIGS. 24 and 25, cable tie braking, positioning and inserting and ejecting mechanism 205 includes a cable tie braking and ejecting assembly having a head retainer guide 215 which is slidably mounted in slots 216 in side plates 218, a retainer member 219 pivotally mounted at a rearward end to guide 215 having a cable tie positioning groove 220 disposed in its forward, distal end, and a spring 221 which resiliently biases retainer member 219 upwardly from retainer guide 215. Retainer member 219, as best seen in FIGS. 32–35 includes a head positioning inset 225 which prevents the head of cable tie 52 from moving backward after it has passed retainer member 219. Also included in mechanism 205 is a slidably mounted head stop 222 disposed in the path of the head of a cable tie, a resilient urethane brake pad 223 disposed between and abutting head stop 222 and a staticly mounted support block 224 which is spaced apart from head stop 222.

An upper tie guide 226 is disposed opposite retainer member 219. Member 219 and spring 221 resiliently bias a cable tie head upwardly against upper tie guide 226 to retain it in position.

Cable tie tensioning and severing mechanism 206, identical in function to mechanism 77 of tool 50 above, includes a gripper assembly 228 having left and right gripper assembly linkages 229 having a forward arm 230 and a downwardly projecting rearward arm 231 which respectfully rotatably mount therebetween, meshing gripper gear 232 and intermediate gear 233; an adjustable tension assembly 234 having a yoke rod 236 secured to tension adjusting knob 238 received in a threaded yoke 239 and biased away from yoke 239 by spring 240, with yoke 239 being connected to a detent cam 241 which is pivotally mounted in side plates 218 by a pin 242; and a strap cutoff blade 243 slidably mounted in slots (not shown) of side plates 218 which is operatively connected by pin 245 to rearward arms 231.

Left and right gripper assembly linkages 229 are disposed outwardly of side plates 218 and pivotally mounted to side plates 218 by axel 246 of intermediate gear 233; apertures being provided in side plates 218 allowing pivotal movement of gripper assembly 228 relative to side plates 218. A detent cam follower 247 (FIG. 24) is rotatably mounted to and between the distal ends of forward arms 230 and disposed to be engaged in detent 248 of detent cam 241.

Disposed adjacent gripper gear 232 is gripper backstop 249 which is pivotally mounted by pin 250. Resilient urethane spacer 251 supported by support block 224 allows limited pivotal forward movement of the lower free end of gripper backstop 249. The lower free end of backstop 249 is aligned with a strap accepting slot 252 (FIG. 24) in strap cutoff blade 243 such that the tip of a cable tie inserted through slot 252 is guided by backstop 249 into engagement with gripper gear 232. A strap guide plate 253 is disposed adjacent to and spaced from gripper backstop 249 which together direct a severed strap outwardly through a tie ejection aperture (not shown in FIGS. 24–35).

As seen in FIG. 25, intermediate gear is driven by gear assembly 254 which is driven by electric motor 204.

An opto-electric sensor 255 is mounted to sense the movement of detent cam 241 and a pivotally mounted air gate 256 is mounted adjacent the exit of pneumatic tube 201 to initially pneumatically seal the cable tie passageway while being movable to allow for movement of head retainer guide 215.

The operation of tool 20 is functionally identical for the corresponding mechanisms of tool 50 with those modifications necessary to accept larger cable ties that are pneumatically propelled through pneumatic tube 201 from a remote dispenser.

Figure 26:
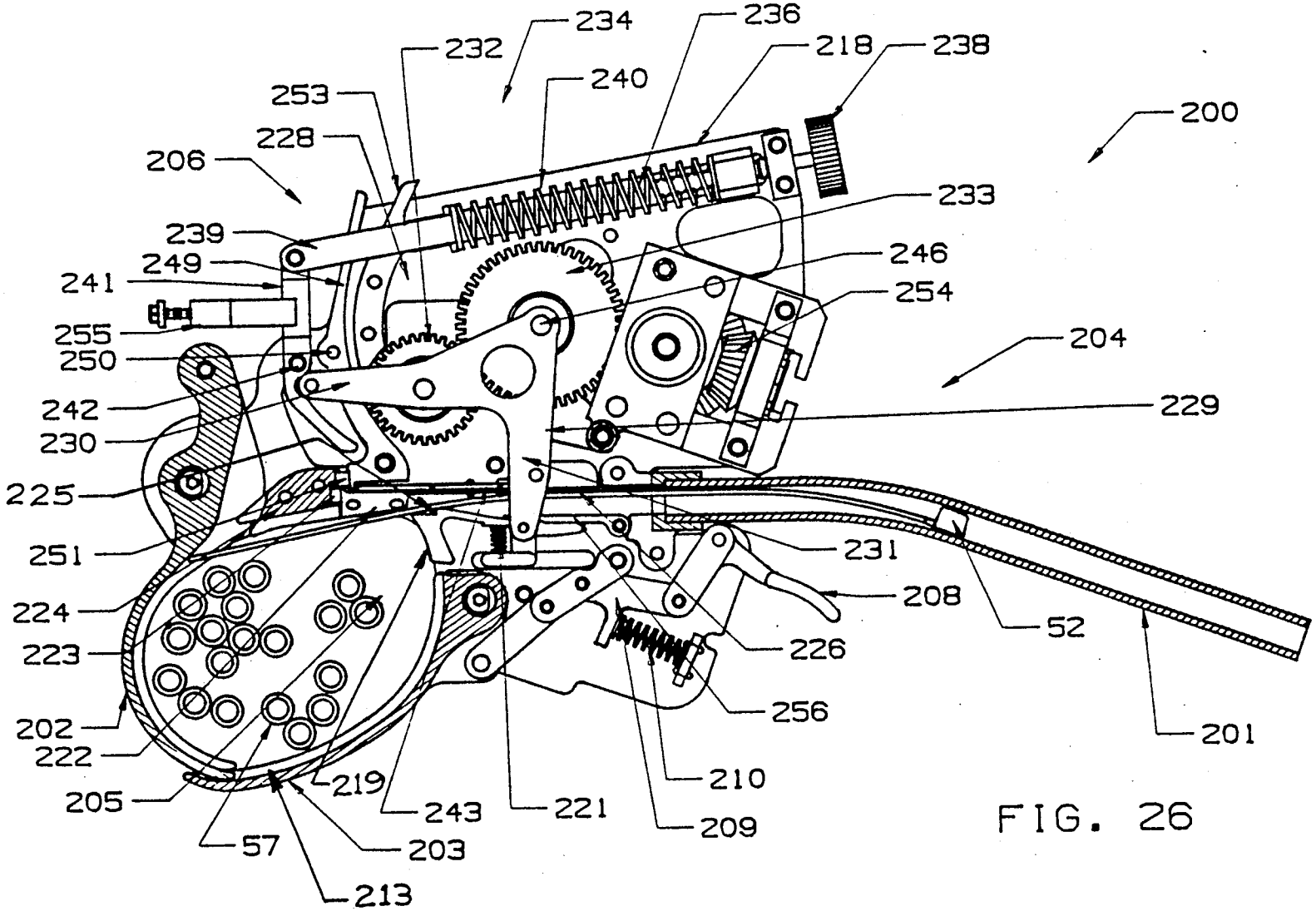
FIG. 26 is a side view similar to FIG. 25, partially in section showing a cable tie being pneumatically advanced into position in the jaws of the tool.
Figure 27:
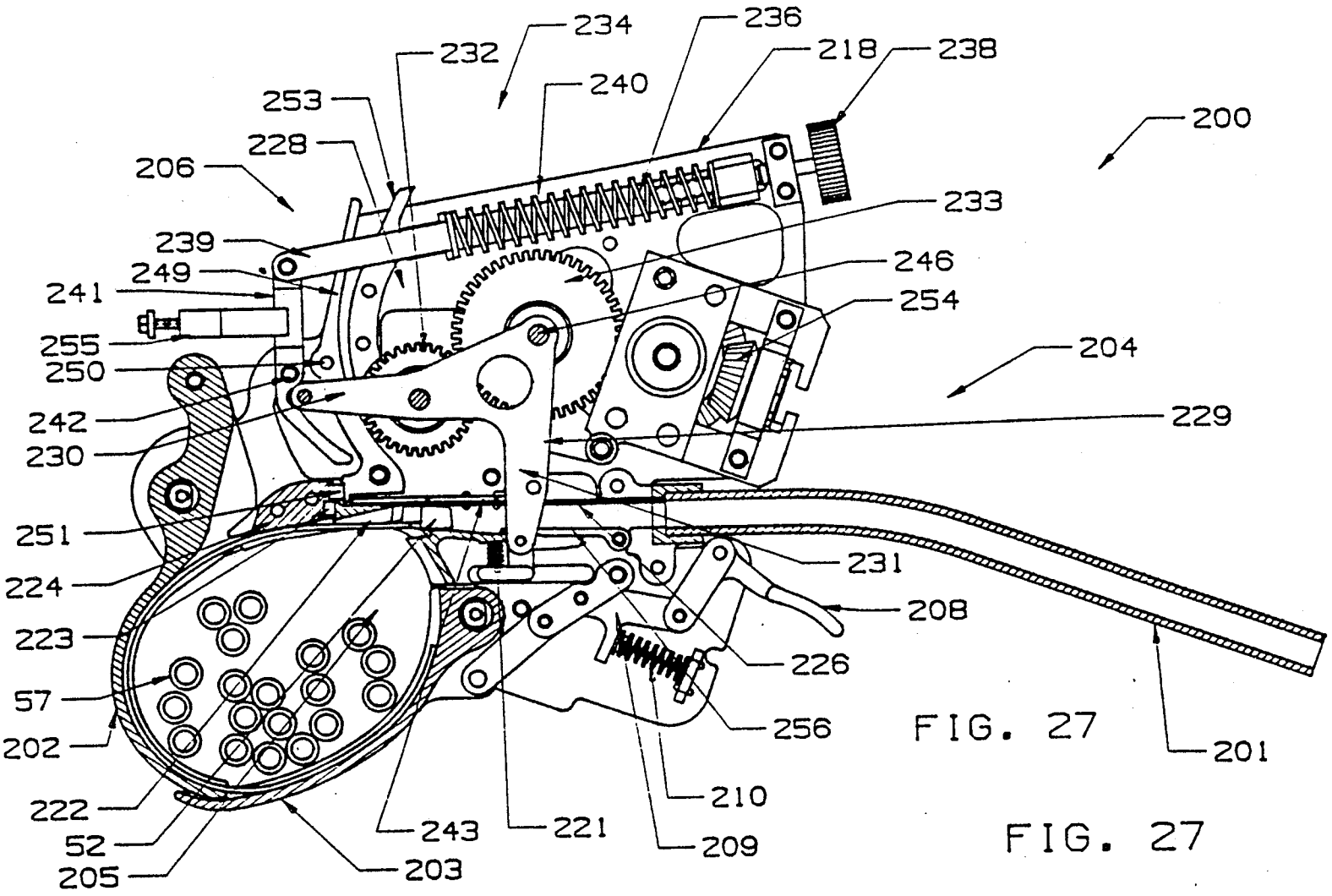
FIG. 27 is a side view similar to FIG. 26 showing the advance of a cable tie just before the head of the cable tie is positioned for insertion of the strap of the cable tie.
Figure 28:
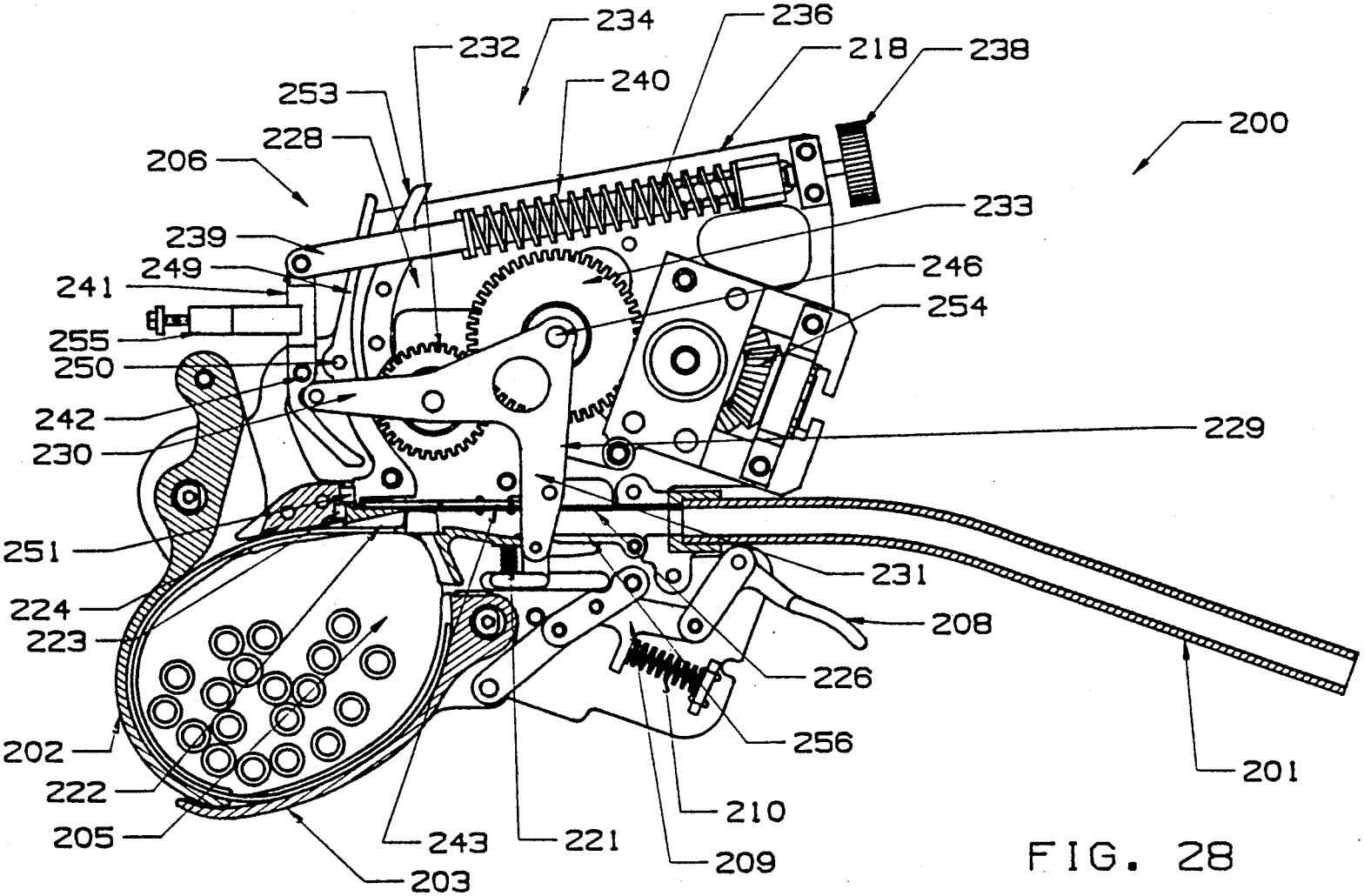
FIG. 28 is a side view similar to FIG. 26 showing the head of the cable tie positioned for insertion of the strap.

As best seen in FIGS. 25–35, tool 200 is operated as follows. Lower jaw 203 is opened by actuating handle 208 and placed around an object to be bundled such as wires 57 and released to close jaw 203. A remote dispenser in a manner known in the art propels a cable tie, strap first, through tube 201 with a blast of air pressure. As seen in FIG. 26, tie strap of cable tie 52 continues past head stop 222 without interference and is guided into grooves 213 of upper and lower jaws 202 and 203 which direct it around wires 57. The head of cable tie 52 initially engages the upper surface of retainer member 219 which is resiliently biased upwardly by spring 221 and is mounted to project into the path of the head of cable tie 52. Retainer member 219 acts as a brake slowing the forward velocity of cable tie 52 before it engages head stop 222. Head stop 222 is disposed to interfere with the forward progress of the head of cable tie 52 and is mounted to allow movement in the direction of advance of cable tie 52 against resilient brake pad 223 which absorbs a portion of the impact of the head of cable tie 52 when it comes to rest against head stop 222.

After the head of cable tie 52 contacts head stop 222 its forward motion is stopped and it is positioned between head stop 222 and retainer member 219, seated within inset 225 on the upper edge of retainer member 219 which resiliently biases it upwardly to accurately and securely position cable tie 52 in tool 200.

Figure 29:
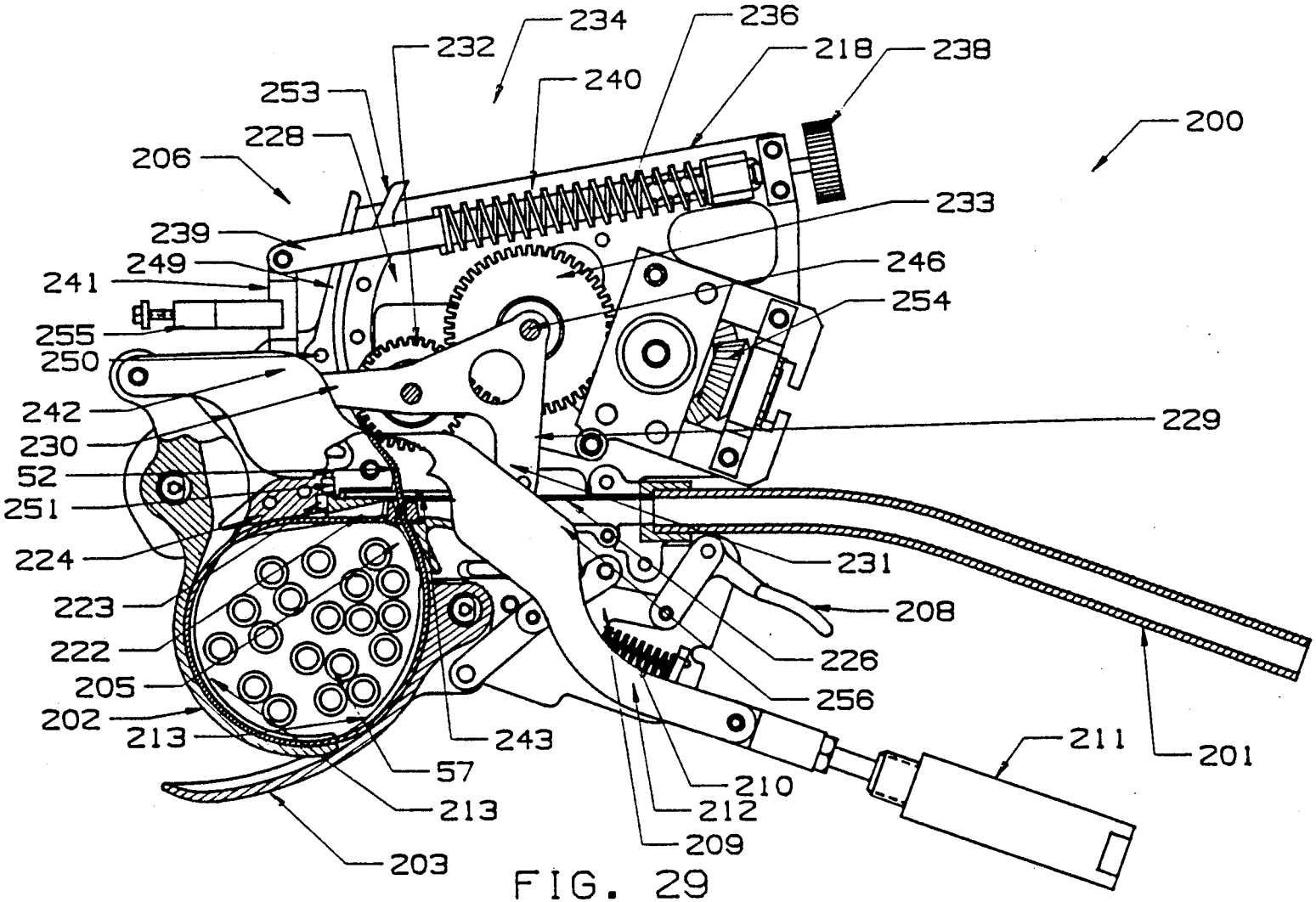
FIG. 29 is a side view similar to FIG. 26 showing a tie being inserted through the head of the cable tie shown in section.

As seen in FIG. 29, pneumatic cylinder 211 is actuated by the control circuitry of tool 200 to extend link 212 to pivot upper jaw 202 upwardly, driving the strap of cable tie 52 through its head through slot 252 in cutoff blade 243 (FIG. 24) and into engagement with gripper gear 232 of cable tie tensioning and severing mechanism 206.

Figure 30:
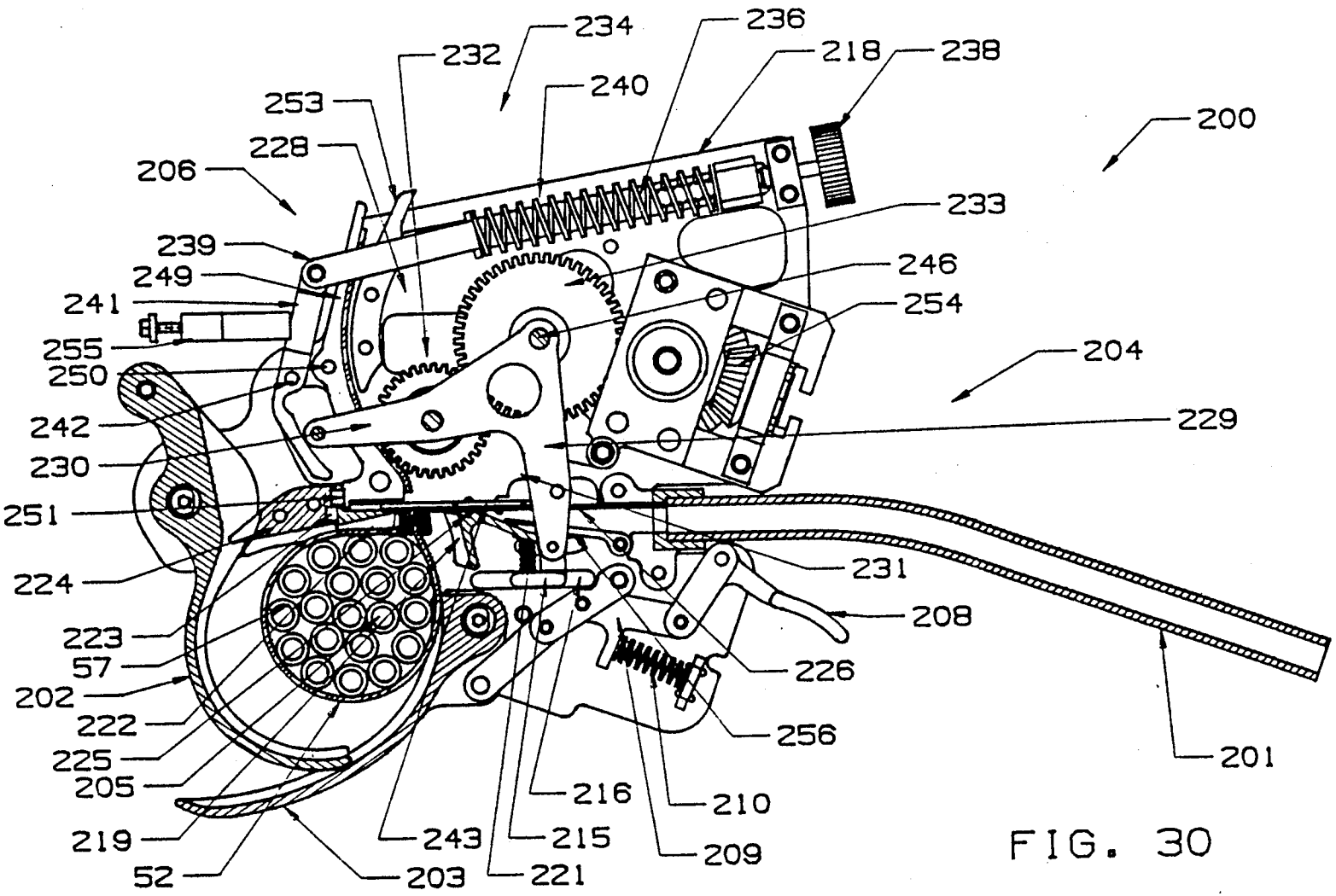
FIG. 30 is a side view similar to FIG. 26 with the mechanism shown in a position after the tensioning mechanism has applied the desired tension to the strap of the cable tie and has pivoted a strap cutoff blade to sever the strap.
Figure 31:
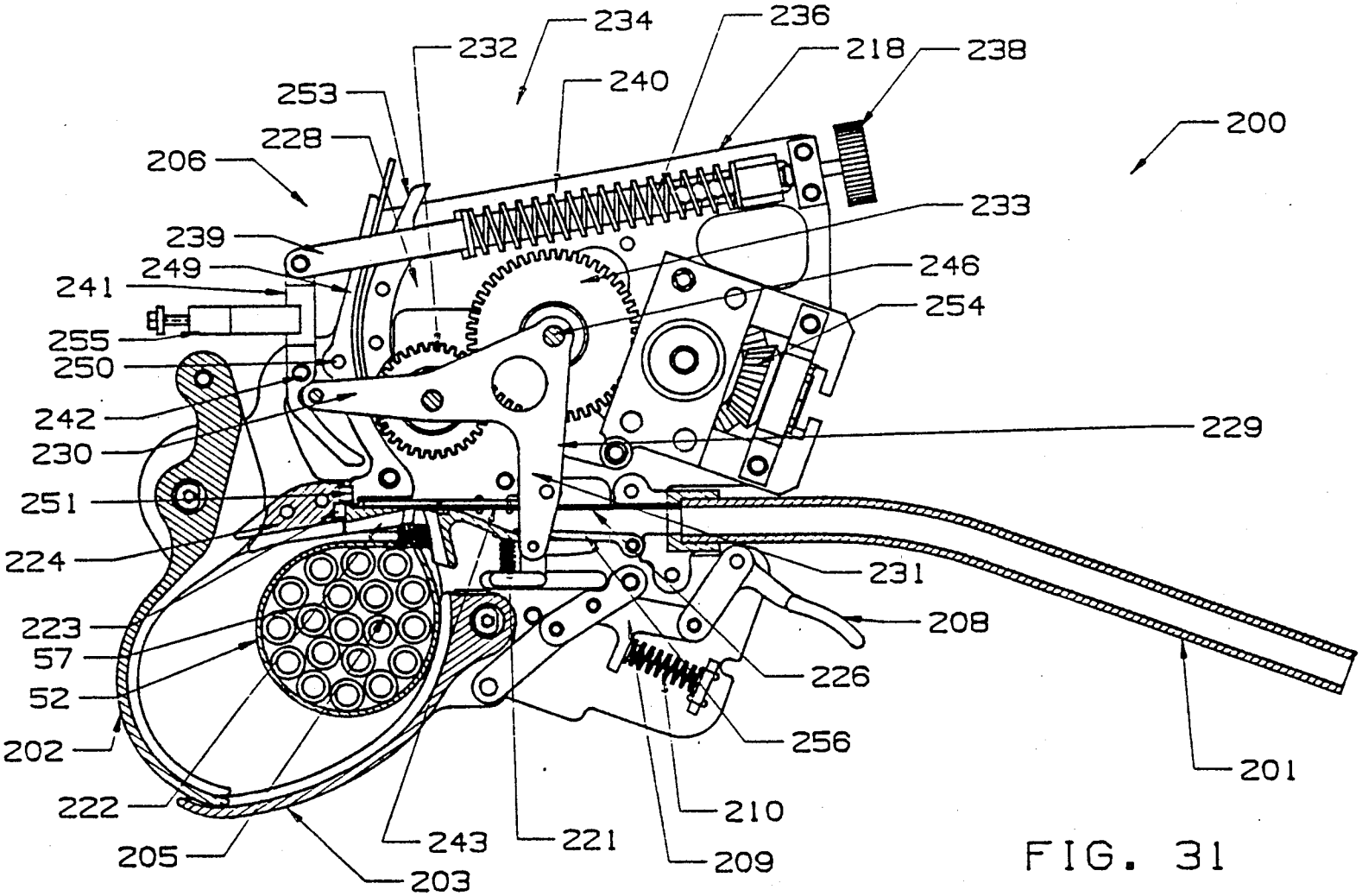
FIG. 31 is a side view similar to FIG. 26 with the mechanism shown in a position just after an ejecting mechanism has ejected, the cable tie head from the tool.
Figures 32, 33:
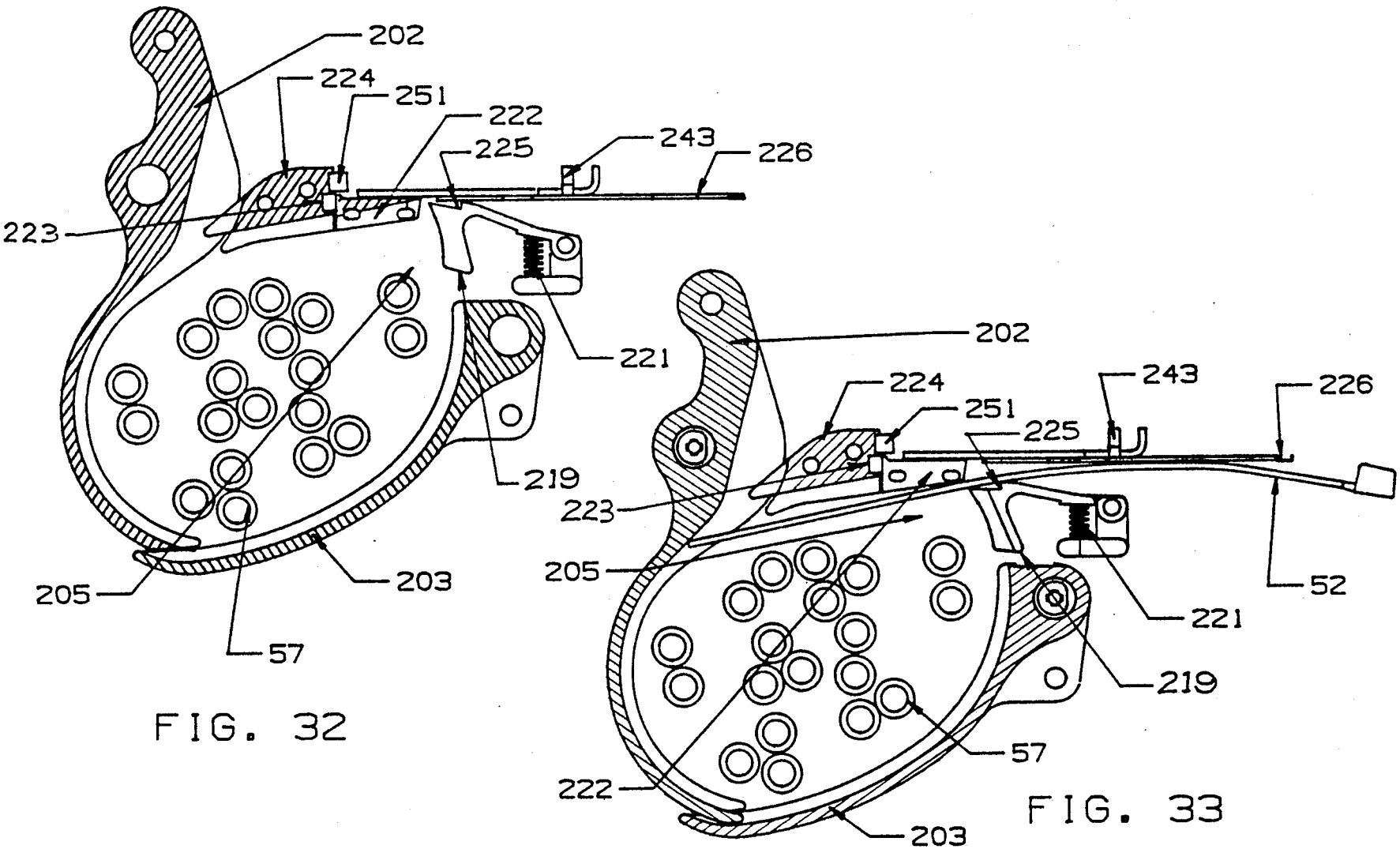
FIGS. 32–35 are sectional views which illustrate in detail the positioning of the cable tie in the jaws of the tool of FIG. 24 as it is advanced and applied around a bundle of wires.
Figure 35:
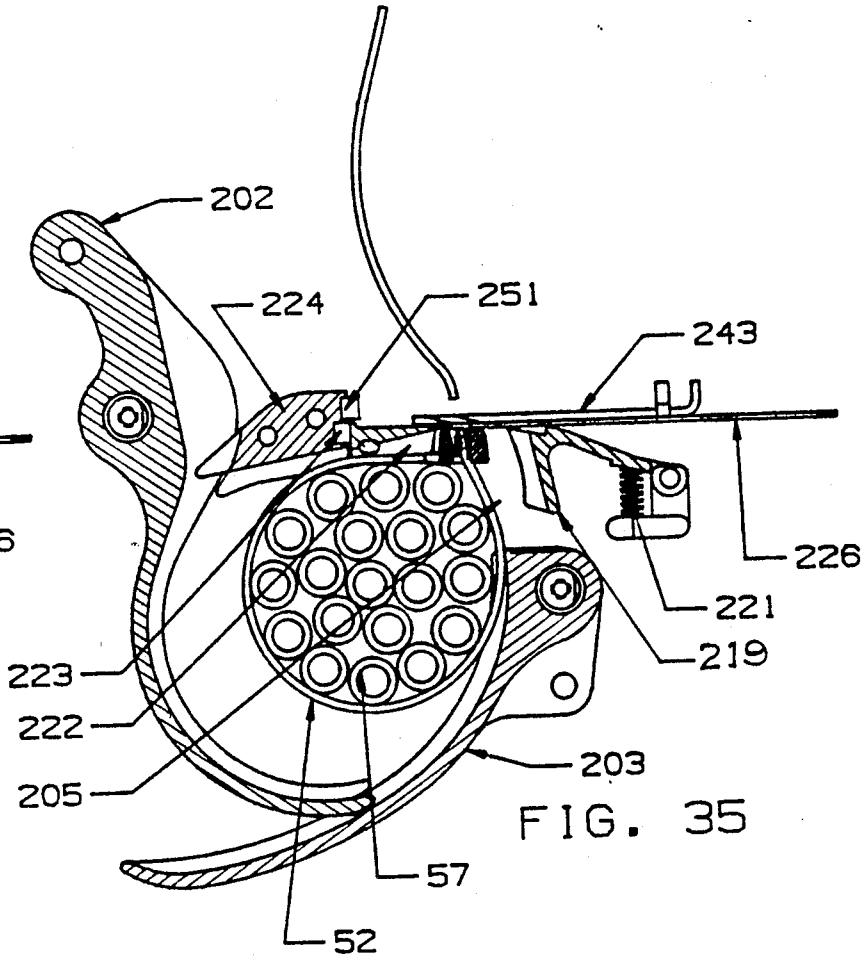
Figure 34:
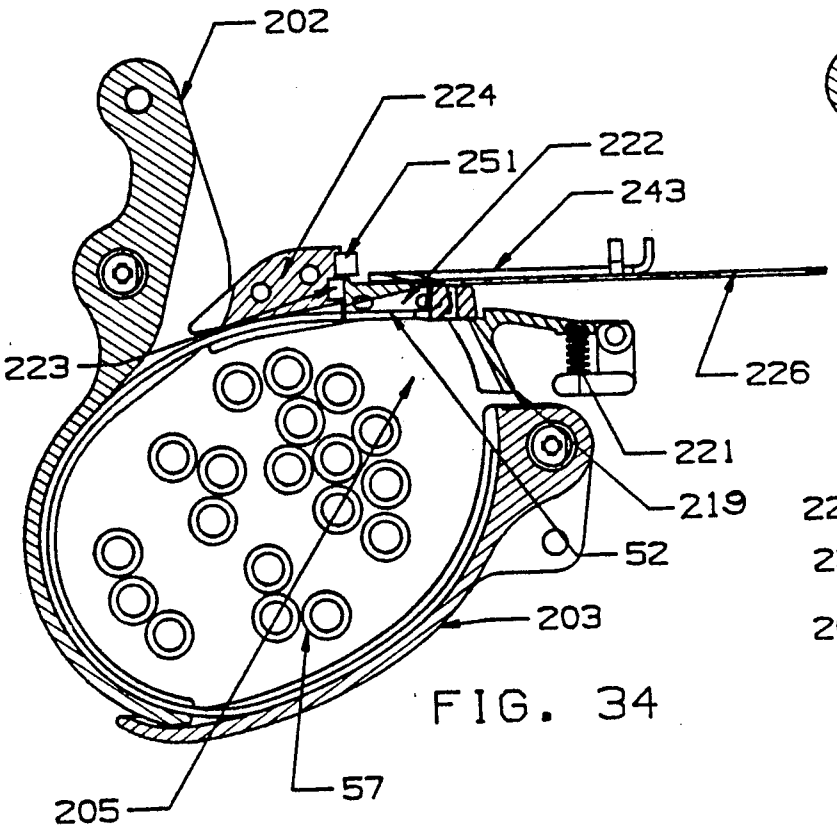

As best seen in FIGS. 29 and 30, the tip of cable tie 52 directed into engagement with gripper gear 232 is driven against gripper backstop 249 by gripper gear 232 which continuously rotates in a clockwise direction to apply tension to the strap of the cable tie and tightened it around wires 57. Backstop 249 is pivotally mounted by pin 250 and resiliently supported at its lower end for limited clockwise movement by resilient spacer 251, which provides a tension assembly that is less sensitive to varying tolerances between the strap thickness of cable ties and gripper assembly 228.

Tension assembly 234 applies a preset force to detent cam follower 247 (FIG. 24) such that as gripper gear 232 withdraws the strap of cable tie 52, increasing the downward force applied to forward arms 230 of left and right gripper assembly linkages 229 a point is reached where the downward force overcomes the force applied by tension assembly 234 which pivots left and right gripper assembly linkages 229 counterclockwise around axel 246. As seen in FIG. 30 counterclockwise movement of rearward arms 231 simultaneously retracts strap cutoff blade 243 to sever the strap of cable tie 52 and retracts head retainer guide 215, with the distal end being withdrawn past the rearward edge of the head of cable tie 52 such that spring 221 resiliently drives head retainer guide 215 upwardly behind the head of cable tie 52.

Severance of the strap releases the downward force on forward arms 230 and left and right gripper assembly linkages 229, driven by the force applied to cam follower 247 by tension assembly 234 pivot in a clockwise direction back to its starting position which concurrently advances retainer member 219 to push the head of cable tie 52 outwardly and eject it from tool 200.

Continued rotation of gripper gear 232 drives the severed strap between gripper backstop 249 and guide plate 232 which direct the strap out of tool 200.

Sensor 255 senses the movement of gripper assembly 228 to turn off motor 204 and complete the tool cycle.

While particular embodiments of the present invention have been shown and described, it will be obvious to those skilled in the art that changes and modifications may be made without departing from the invention in its broader aspects. The matter set forth in the foregoing description and accompanying drawings is offered by way of illustration only and not as a limitation. The actual scope of the invention is intended to be defined in the following claims when viewed in their proper perspective based on the prior art.

We claim:

1. A portable cable tie application tool for fastening an individual cable tie around an object where the cable tie has a strap and a strap locking head and is provided in a continuous ribbon of cable ties, comprising:

upper and lower jaws for positioning the cable tie around an object to be fastened;

tensioning means for withdrawing the strap of the cable tie from the locking head of the cable tie to tighten the cable tie around the object to be fastened;

cable tie receiver means for positioning the ribbon of cable ties, separating a leading cable tie from the ribbon of cable ties and positioning the separated cable tie for advancement to the upper and lower jaws; and cable tie advancing means for advancing the separated cable tie into position in the upper and lower jaws including a carriage, carriage mounting means for mounting the carriage to the tool for reciprocal movement between a rearward position and a forward position and cable tie pusher means carried on the carriage for pushing the separated cable tie from the cable tie receiver means to the upper and lower jaws;

wherein the upper jaw is pivotally mounted to the tool and operatively connected to a linkage means for pivoting the upper jaw upwardly within the lower jaw to insert the strap of a cable tie positioned therein through the locking head of the cable tie into engagement with the tensioning means and wherein the carriage includes insertion cam means disposed for engaging the linkage means to actuate the linkage means to pivot the upper jaw and insert the cable tie when the carriage is advanced to the forward position whereby the movement of the carriage effects the timed advancement of the cable tie within the tool and the timed insertion of the cable tie through the locking head of the cable tie.

2. A portable cable tie application tool, as set forth in claim 1, including a ratchet means for incrementally advancing the cable tie receiver means to advance the cable tie ribbon and sequentially separate and position the leading cable tie and wherein the carriage includes ratchet cam means disposed for engaging the ratchet means to actuate the ratchet means when the carriage is retracted to the rearward position whereby the movement of the carriage effects the timed provision of a separated cable tie from the ribbon of cable ties, the timed advancement of the cable tie within the tool and the timed insertion of the cable tie through the locking head of the cable tie.

3. A portable cable tie application tool, as set forth in claim 2, wherein the cable tie advancing means includes a carriage drive means for reciprocating the carriage including spaced apart first and second sprockets that mount a carriage chain including an integral chain link, the chain link projecting inwardly between an upper and lower extent of the carriage chain and positioning an integral pin in line with axes of the first and second sprockets, the pin being connected to the carriage such that it translates the carriage with the chain link in forward and rearward directions while being free to rotate relative to the carriage as the chain link is advanced around the first and second sprockets whereby continuous rotation of the carriage chain reciprocates the pin and the carriage between the forward and rearward positions.

4. A portable cable tie application tool as set forth in claim 3, including cable tie ejection means for ejecting the cable tie from the tool after it has been fastened around the object including a head retainer guide movably mounted in the tool for translation from a forward position to a rearward position; a retainer member pivotally mounted to the head retainer guide and resiliently biased upward against the head of a cable tie positioned in the upper and lower jaws, when the head retainer guide is in the forward position, to retain the head of the cable tie in the tool; and actuation means for reciprocating the head retainer guide between the forward and rearward positions, wherein rearward movement of the head retainer guide withdraws the retainer member from engagement with the head of the cable tie and positions a distal end of the retainer member behind the head of the cable tie such that the subsequent return of the retainer member to the forward position ejects the head of the cable tie from the tool.

5. A portable cable tie application tool as set forth in claim 4, wherein the carriage drive means and the tensioning mechanism are both driven by a single electric motor.

6. A portable cable tie application tool for fastening an individual cable tie around an object where the cable tie has a strap and a strap locking head and is provided in a continuous ribbon of cable ties, comprising:

upper and lower jaws for positioning the cable tie around an object to be fastened;

tensioning means for withdrawing the strap of the cable tie from the locking head of the cable tie to tighten the cable tie around the object to be fastened;

cable tie receiver means for positioning the ribbon of cable ties, separating a leading cable tie from the ribbon of cable ties and positioning the separated cable tie for advancement to the upper and lower jaws; and cable tie advancing means for advancing the separated cable tie into position in the upper and lower jaws including a carriage, carriage mounting means for mounting the carriage to the tool for reciprocal movement between a rearward position and a forward position and cable tie pusher means carried on the carriage for pushing the separated cable tie from the cable tie receiver means to the upper and lower jaws; wherein the cable tie advancing means includes a carriage drive means for reciprocating the carriage including spaced apart first and second sprockets that mount a carriage chain including an integral chain link, the chain link projecting inwardly between an upper and lower extent of the carriage chain and positioning an integral pin in line with axes of the first and second sprockets, the pin being connected to the carriage such that it translates the carriage with the chain link in forward and rearward directions while being free to rotate relative to the carriage as the chain link is advanced around the first and second sprockets whereby continuous rotation of the carriage chain reciprocates the pin and the carriage between the forward and rearward positions.

7. A portable cable tie application tool as set forth in claim 6, wherein the carriage drive means is driven by a single non-reversible electric motor.

8. A cable tie application tool for fastening a cable tie around an object where the cable tie has a strap and a strap locking head, comprising:

upper and lower cable tie positioning jaws;

strap severance means for cutting excess strap of a tensioned cable tie;

a cable tie tensioning means for withdrawing the strap of the cable tie from the locking head of the cable tie to tighten the cable tie around the object to be fastened, the tensioning means including a gripper assembly mounted to pivot between a tensioning position and a strap severance position including a gripper gear disposed to engage the strap of the cable tie to withdraw the strap from the locking head of the cable tie when the gripper assembly is in the tensioning position and tension sensing means for pivoting the gripper assembly to the strap severance position when a preset tension is reached in the strap wherein the pivotal motion of the gripper assembly actuates the strap severance means to cut the strap of the tensioned cable tie and release it from engagement with the gripper gear; and means for ejecting the head of the tensioned cable tie from the tool actuated by the pivotal motion of the gripper assembly.

9. A cable tie application tool as set forth in claim 8, wherein the means for ejecting includes a head retainer guide movably mounted in the tool and connected to the gripper assembly for translation with the pivotal movement of the gripper assembly from a forward position to a rearward position; and a retainer member pivotally mounted to the head retainer and resiliently biased upward against the head of a cable tie positioned in the upper and lower jaws when the head retainer guide is in the forward position to retain the head of the cable tie in the tool, wherein rearward movement of the head retainer guide with the pivotal movement of the gripper assembly to the strap severance position withdraws the retainer member from engagement with the head of the cable tie and positions a distal end of the retainer member behind the head of the cable tie such that the subsequent return of the retainer member to the forward position ejects the head of the cable tie from the tool.

10. A cable tie application tool as set forth in claim 9, wherein a distal end of the retainer member includes a strap guiding groove that is positioned to guide the strap of the cable tie into the locking head.

11. A cable tie application tool as set forth in claim 10, wherein the gripper gear of the cable tie tensioning means is disposed adjacent and spaced from a gripper backstop such that the strap of a cable tie is directed by the gripper backstop into engagement with the gripper gear and wherein the gripper backstop is pivotally mounted and supported at a lower end by a resilient spacer that allows limited pivotal forward movement of the lower end of the gripper backstop such that the tension assembly is less sensitive to varying tolerances in cable ties and the tension assembly.

12. A cable tie application tool as set forth in claim 9, including means for pneumatically propelling a cable tie along a path into position in the upper and lower jaws and wherein the resiliently biased retainer member is disposed to project into the path of the cable tie to resiliently decelerate the cable tie such that impact induced failure of the cable tie is minimized.

13. A cable tie application tool as set forth in claim 12, including a head stop disposed in the path of the cable tie in a position to allow the strap of the cable tie to pass but to stop the forward motion of the cable tie and a resilient brake pad disposed forward of the head stop, wherein the head stop is movably mounted to allow movement of the head stop against the resilient brake pad such that the impact of the head of the cable tie against the head stop is resiliently dissipated.

14. A cable tie application tool as set forth in claim 12, wherein a distal end of the retainer member includes a strap guiding groove that is positioned to guide the strap of the cable tie into the locking head.

15. A cable tie application tool as set forth in claim 12, wherein the distal end of the retainer member includes a head positioning inset disposed to prevent rearward movement of a head of cable tie disposed forwardly of the retainer member.

16. A cable tie application tool as set forth in claim 12, wherein the gripper gear of the cable tie tensioning means is disposed adjacent and spaced from a gripper backstop such that the strap of a cable tie is directed by the gripper backstop into engagement with the gripper gear and wherein the gripper backstop is pivotally mounted and supported at a lower end by a resilient spacer that allows limited pivotal forward movement of the lower end of the gripper backstop such that the tension assembly is less sensitive to varying tolerances in cable ties and the tension assembly.

* * * * *